US008188389B2

(12) United States Patent
Ogura

(10) Patent No.: US 8,188,389 B2
(45) Date of Patent: May 29, 2012

(54) SLIDE SWITCH

(75) Inventor: Takashi Ogura, Kohtoh-ku (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 12/840,735

(22) Filed: Jul. 21, 2010

(65) Prior Publication Data

US 2011/0017579 A1 Jan. 27, 2011

Related U.S. Application Data

(63) Continuation of application No. PCT/JP2009/050952, filed on Jan. 22, 2009.

(30) Foreign Application Priority Data

Jan. 22, 2008 (JP) ..... 2008-011675

(51) Int. Cl.
*H01H 13/00* (2006.01)

(52) U.S. Cl. ..... 200/16 A

(58) Field of Classification Search ..... 200/16 A, 200/561–563, 52 R, 253, 556
See application file for complete search history.

(56) References Cited

U.S. PATENT DOCUMENTS

| | | | | |
|---|---|---|---|---|
| 5,685,419 | A * | 11/1997 | Takano | 200/563 |
| 6,091,038 | A * | 7/2000 | Murphy et al. | 200/563 |
| 6,919,519 | B2 * | 7/2005 | Ravnkilde et al. | 200/52 R |

FOREIGN PATENT DOCUMENTS

| | | | |
|---|---|---|---|
| JP | 08-115637 | A | 5/1996 |
| JP | 09-092085 | A | 4/1997 |
| JP | 2006-140092 | A | 6/2006 |
| JP | 2006-236784 | A | 9/2006 |

* cited by examiner

*Primary Examiner* — Edwin A. Leon
(74) *Attorney, Agent, or Firm* — Sughrue Mion, PLLC

(57) ABSTRACT

A slide switch including: an operating member which moves circular arcuately in a predetermined movement stroke relative to a main surface of a printed wiring board for outputting a plurality of electrical signals and selects between the electric signals; a converting mechanism for converting a circular arcuate movement of the operating member into a rectilinear movement relative to the main surface of the printed wiring board; and a moving member rectilinearly moved relative to the main surface of the printed wiring board by the converting mechanism and determining, in cooperation with the printed wiring board, an electrified state corresponding to an electric signal selected by the operating member.

15 Claims, 28 Drawing Sheets

SLIDE SWITCH

BACKGROUND OF THE INVENTION

1. Technical Field of the Invention

The present invention is directed to a slide switch, and more particularly relates to a slide switch in which an electrified state such as resistance value varies in accordance that an operating member is manually operated.

It is to be noted that, for those designated countries which permit the incorporation by reference, the contents described and/or illustrated in the documents relevant to Japanese Patent Application No. 2008-11675 filed on Jan. 22, 2008 will be incorporated herein by reference, as a part of the description and/or drawings of the present application.

2. Description of the Related Art

As shown in FIG. 26, known in the art is a slide switch 111 configured such that an operating member 113 is rectilinearly operated along the horizontal direction in FIG. 26, while a moving member 115 cooperating with the operating member 113 and a brush constructing member 117 integrally provided with the moving member 115 also rectilinearly move, thereby varying a resistance value and the like (Patent Document 1: Japanese Patent Application publication No. H8 (1996)-115637).

Because electronic devices such as video cameras in which the slide switch 111 is to be used are progressed to being reduced more and more in sizes, it is required to minimize the dimensions of the slide switch 111 as much as possible. To this end, it may be conceivable to reduce the longitudinal dimension of the slide switch 111 i.e. the size along the horizontal direction in FIG. 26. However, if the longitudinal dimension is reduced, then the stroke of the operating member 113 is also to be reduced thereby deteriorating the handling feelings.

In such circumstances, as shown in FIG. 27 and FIG. 28, there is proposed a slide switch 151 configured such that an operating member 153 is moved circular arcuately relative to a base material 115 along the arrow shown in FIG. 27 thereby preventing the reduction in stroke of the operating member 153 (Patent Document 2: Japanese Patent Application Publication No. 2006-236784). In this slide switch 151, a brush constructing member 157 provided with the operating member 153 is also moved circular arcuately.

According to the slide switch 151 disclosed in the above Patent Document 2, however, the wiring pattern (pattern configured of resistive element) 159 is required to be provided circular arcuately as shown in FIG. 27. Accordingly, there are problems including that the height dimension H10 of the slide switch 151 becomes large compared to that of the slide switch 111 shown in FIG. 26.

The problem to be solved by the present invention or the object is to provide a slide switch which allows the height thereof to be reduced compared with that of the prior art without increasing the size of the operating member in the sliding direction thereof.

SUMMARY OF THE INVENTION

In order to solve the above problem, the present invention provides a slide switch comprising: an operating member which moves circular arcuately in a predetermined movement stroke relative to a main surface of a printed wiring board for outputting a plurality of electrical signals and selects between the electrical signals; a converting mechanism for converting a circular arcuate movement of the operating member into a rectilinear movement relative to the main surface of the printed wiring board; and a moving member rectilinearly moved relative to the main surface of the printed wiring board by the converting mechanism and determining, in cooperation with the printed wiring board, an electrified state corresponding to an electrical signal selected by the operating member.

According to the present invention, the circular arcuate movement of the operating member is converted by the converting mechanism into the rectilinear movement of the moving member. Therefore, it is enabled to reduce the height compared with that of the prior art without increasing the size of the operating member in the movement direction thereof.

DESCRIPTION OF REFERENCE NUMERALS

Figure 1:
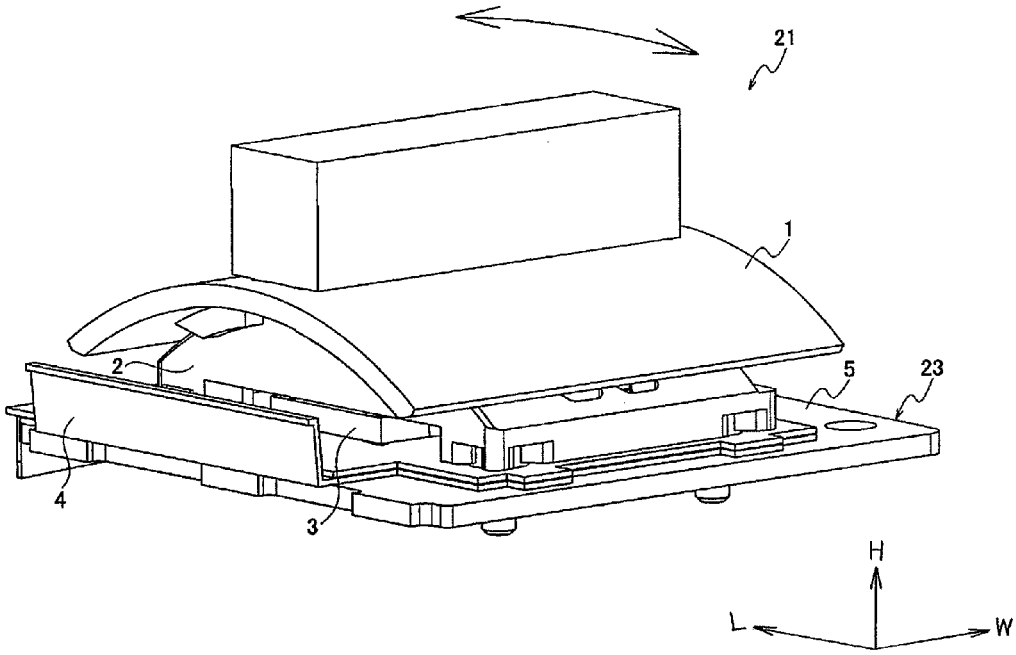
FIG. 1 is a perspective view illustrating a slide switch according to an embodiment of the present invention.

1; operating member
1*a*; projecting portions (first engaging portion)
1*b*; engaged portions
1*c*; click portions
1*d*; sliding portions
1*e*; sliding portions
2; case
2*a*; sliding surface
2*b*; sliding surfaces
2*c*; sliding portions
2*d*; stopper portions
2*e*; opening sections
3; moving member
3*a*; fitting portions (second engaging portion)
3*b*; curved surfaces
3*c*; limiting portions
4; printed wiring board
4*a*; wiring patterns
5; mounting plate
6; switching brush
7; cushions
8; compression coil spring
9; converting mechanism
21; slide switch
23; base material
27; contacts
29; folded region
31; printed wiring board main body
33; conductor thin film
35; through opening
41; cut off portions
90; original position reset mechanism

DESCRIPTION OF THE PREFERRED EMBODIMENT

Hereinafter, embodiments according to the present invention will be described referring to the drawings. The present embodiment involves a slide switch 21 available as a zoom switch for operating a zooming lens of a video camera or an ON/OFF switch for power supplying, for example.

Figure 2:
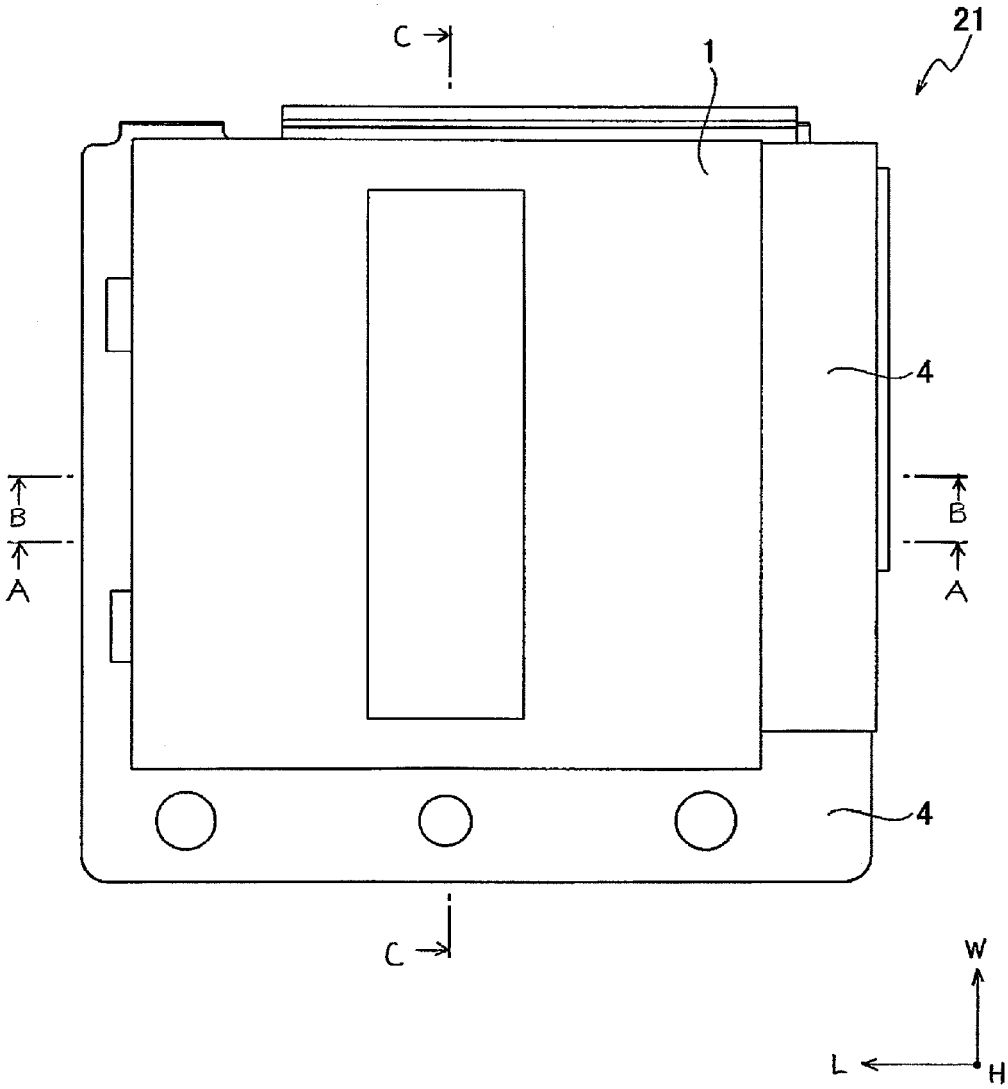
FIG. 2 is a plan view illustrating the slide switch shown in FIG. 1.
Figure 3:
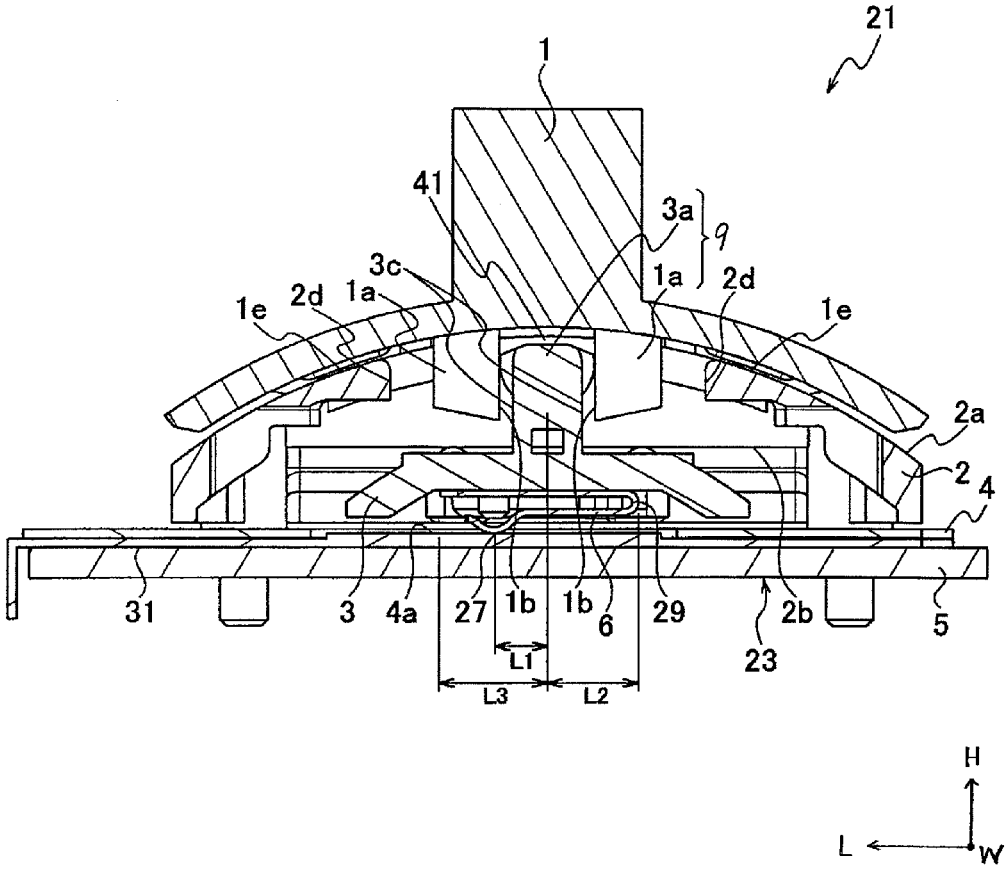
FIG. 3 is a cross-sectional view along the line A-A in FIG. 2 (operating member 1 being at neutral position)

As shown in FIG. 1 to FIG. 3, the slide switch 21 according to the present embodiment comprises: an operating member 1 which moves circular arcuately in a predetermined movement stroke relative to the main surface of a printed wiring board 4 for outputting a plurality of electrical signals and selects a desired electrical signal from the plurality of electrical signals; a converting mechanism 9 for converting the circular arcuate movement of the operating member 1 into a rectilinear movement relative to the main surface of the printed wiring board 4; a moving member 3 rectilinearly moved relative to the main surface of the printed wiring board 4 by the converting mechanism 9 and determining, in cooperation with the printed wiring board 4, an electrified state corresponding to the electrical signal selected by the operating member 1; a base material 23 provided with the printed wiring board 4 and movably supporting each of the operating member 1 and the moving member 3; and a switching brush 6 provided on the moving member 3 and having contacts 27 to contact with wiring patterns 4*a* of the printed wiring board 4.

The operating member 1 is configured of an insulating material such as resin and is to be operated by a human finger when the slide switch 21 is installed onto a video camera or the like. In addition, the operating member 1 engages with a cylindrical lateral face shaped convex surface of the base material 23 so as to form sliding pairs, for example, and is provided as being arcuately movable relative to the base material 23. It is to be noted that the cylindrical lateral face shaped convex surface of the base material 23 is intended to mean a smaller convex surface when a cylindrical lateral face is divided into two convex surfaces at a plane parallel to the cylindrical axis.

The moving member 3 is configured of an insulating material such as resin and is constructed as an independent member separated from the operating member 1. In addition, the moving member 3 engages with the operating member 1 and also engages with a flat surface area of the base material 23 so as to form sliding pairs, for example, at the concave surface side of the cylindrical lateral face shape of the base material 23. More specifically, the moving member 3 is provided as being rectilinearly movable, relative to the base material 23, responding to the movement of the operating member 1 in a direction approximately same as the direction in which the operating member 1 moves.

The switching brush 6, which is configured of a conductor with elasticity, such as metal, has contacts 27 and is provided with the moving member 3 such that the contacts 27 contact with the wiring patterns 4*a*.

The wiring patterns 4*a* are provided with the printed wiring board 4 of thin plate-like shape and are configured of thin resistive elements or thin conductors. The wiring patterns 4*a* are provided relevantly on the flat surface area of the base material 23 such that the thickness directions of the wiring patterns 4*a* are orthogonal to the flat surface area of the base material 23 and the longitudinal directions of the wiring patterns 4*a* are coincident with the movement direction of the moving member 3.

The base material 23 comprises a flat plate shaped mounting plate 5 configured of a conductor such as metal and a case 2 configured of an insulating material such as resin.

The slide switch 21 is assembled in the status where the mounting plate 5, the printed wiring board 4, the switching brush 6, the moving member 3, the case 2 and the operating member 1 are overlapped in this order, and the mounting plate 5 is fixed to a housing of video camera or the like thereby the slide switch 21 is embedded on the video camera.

In the present specification, the direction of overlapping the mounting plate 5, the printed wiring board 4, the switching brush 6, the moving member 3, the case 2 and the operating member 1 i.e. the direction orthogonal to the plane of the mounting plate 5 is referred to as height direction H of the slide switch 21, and the operating member 1 side and the mounting plate 5 side thereof are referred to as upper side and lower side, respectively. In addition, the moving direction of the moving member 3 or the operating member 1 is referred to as longitudinal direction L of the slide switch 21, and the direction orthogonal to both the height direction H and the longitudinal direction L is referred to as width direction W.

These directions H, L and W are indicated in primary drawings as "H", "L" and "W", respectively.

It is to be noted that, when the slide switch 21 according to the present embodiment is embedded into a video camera or the like, these directions H, L and W are not necessarily correspond respectively to the height direction, the longitudinal direction and the width direction of the camera.

The slide switch 21 according to the present embodiment will be hereinafter described in more detail.

Figure 7:
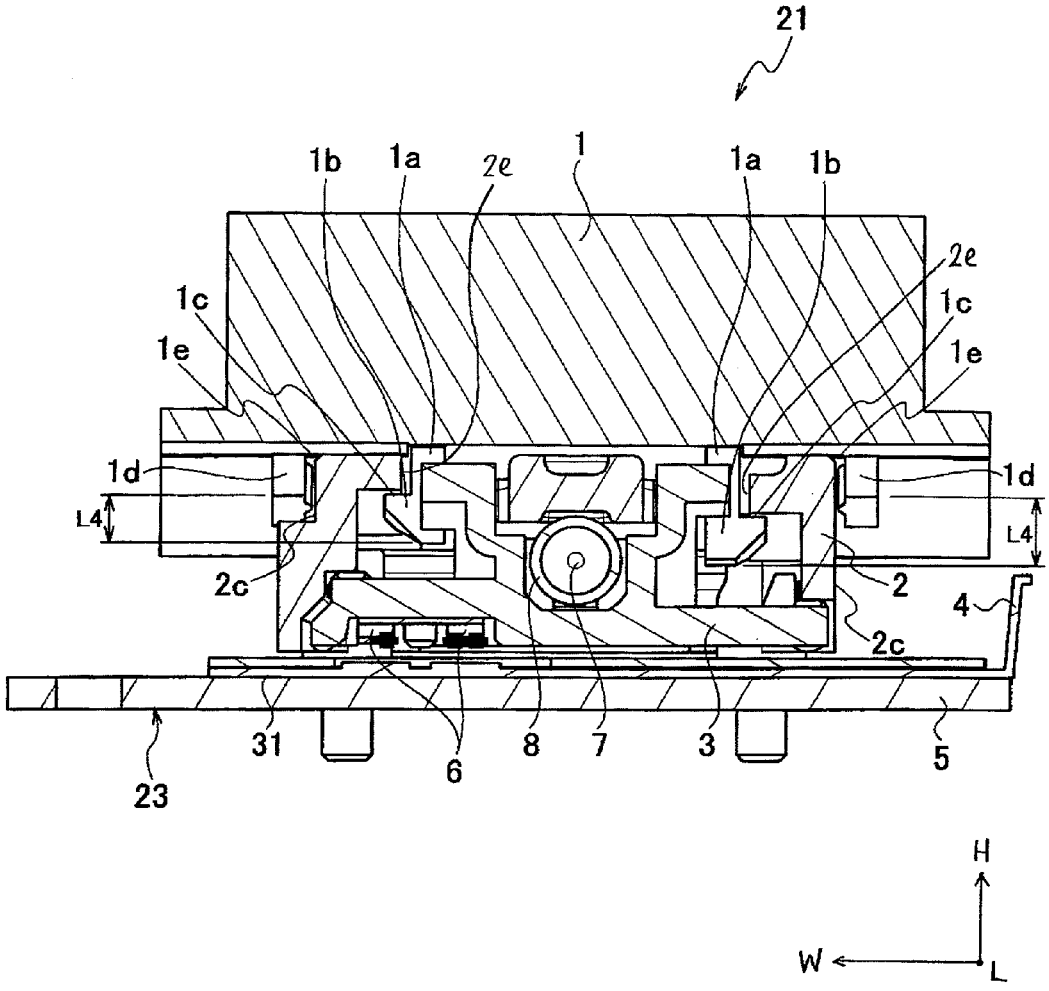
FIG. 7 is a cross-sectional view along the line C-C in FIG. 2.
Figure 23:
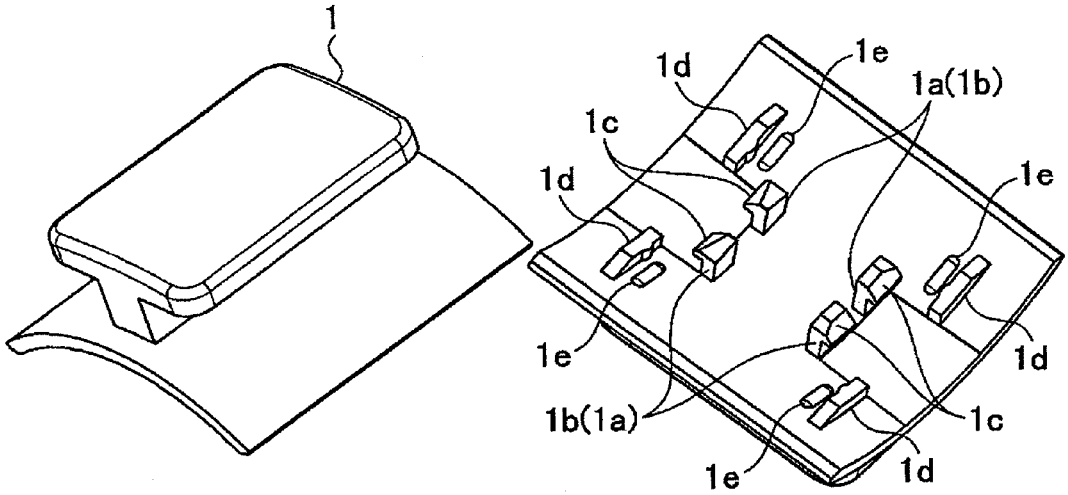
FIG. 23 provides perspective views illustrating the operating member shown in FIG. 1.

As shown in the right of FIG. 23, the operating member 1 has, on the engaging side thereof with the base material 23 (lower side in FIG. 3), projecting portions 1*a* (corresponding to the first engaging portion of the invention) to fit with the moving member 3, engaged portions 1*b* to be engaged with opening sections 2*e* of the case 2, click portions 1*c* formed at ends of the projecting portions 1*a* for snapping the operating member 1 into the case 2 such that the operating member 1 is capable of rotatively moving (arcuately moving), sliding portions 1*d* to be guided by side surfaces 2*c* of the case 2 and each having a projecting amount smaller by L4 (refer to FIG. 7) than that of each projecting portion 1*a*, and sliding portions 1*e* to slide on an arcuate sliding surface 2*a* of the case 2. When the operating member 1 is snapped into the case 2, the case 2 intervenes between the sliding portions 1*e* and the click portions 1*c*, and the operating member 1 is embedded so as to be capable of rotatively moving (arcuately moving) along the sliding surface 2*a* of the case 2.

Figure 20:
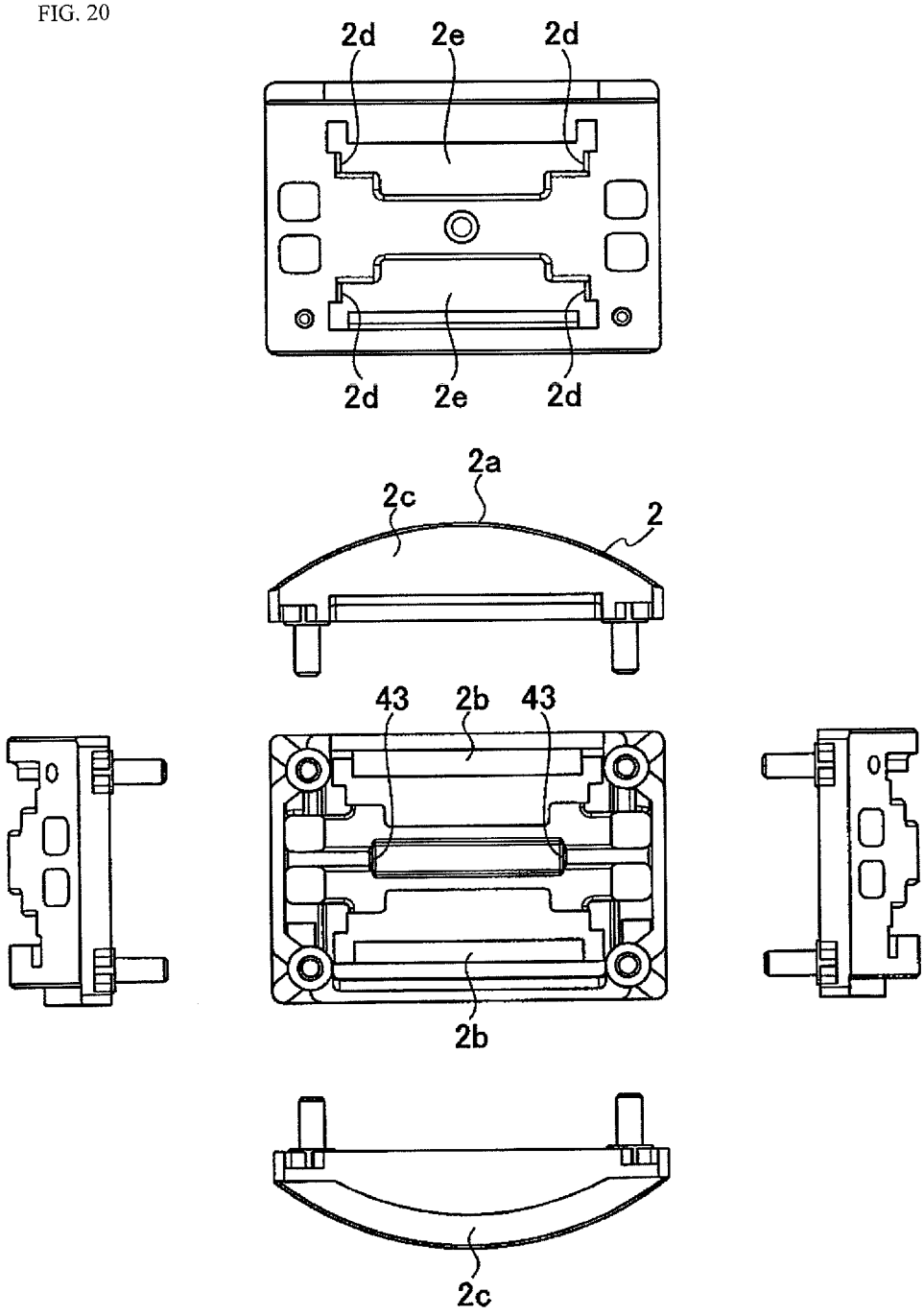
FIG. 20 provides trigonometric six basic views illustrating the case shown in FIG. 1.
Figure 21:
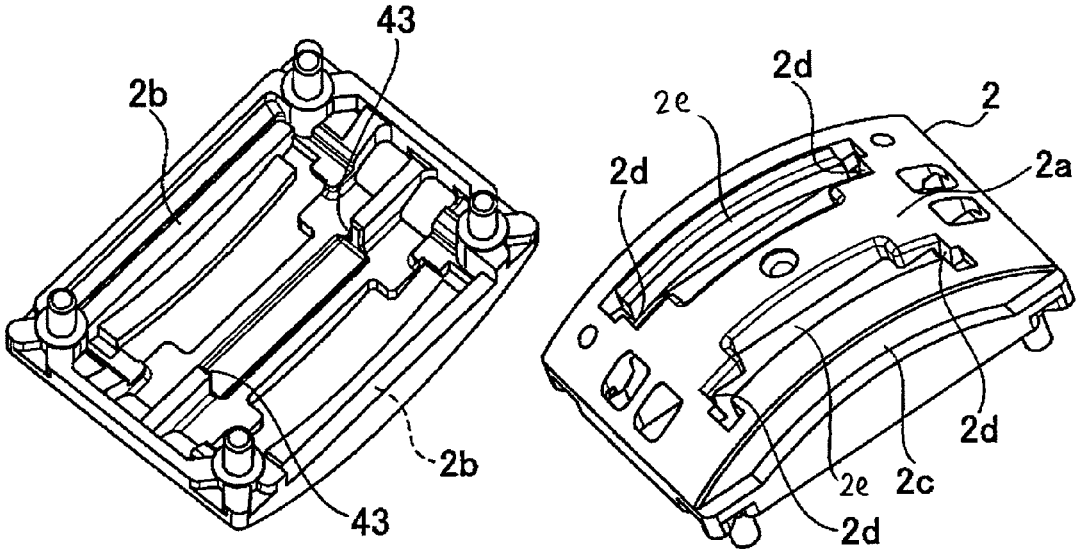
FIG. 21 provides perspective views (top and back) illustrating the case shown in FIG. 1.
Figure 22:
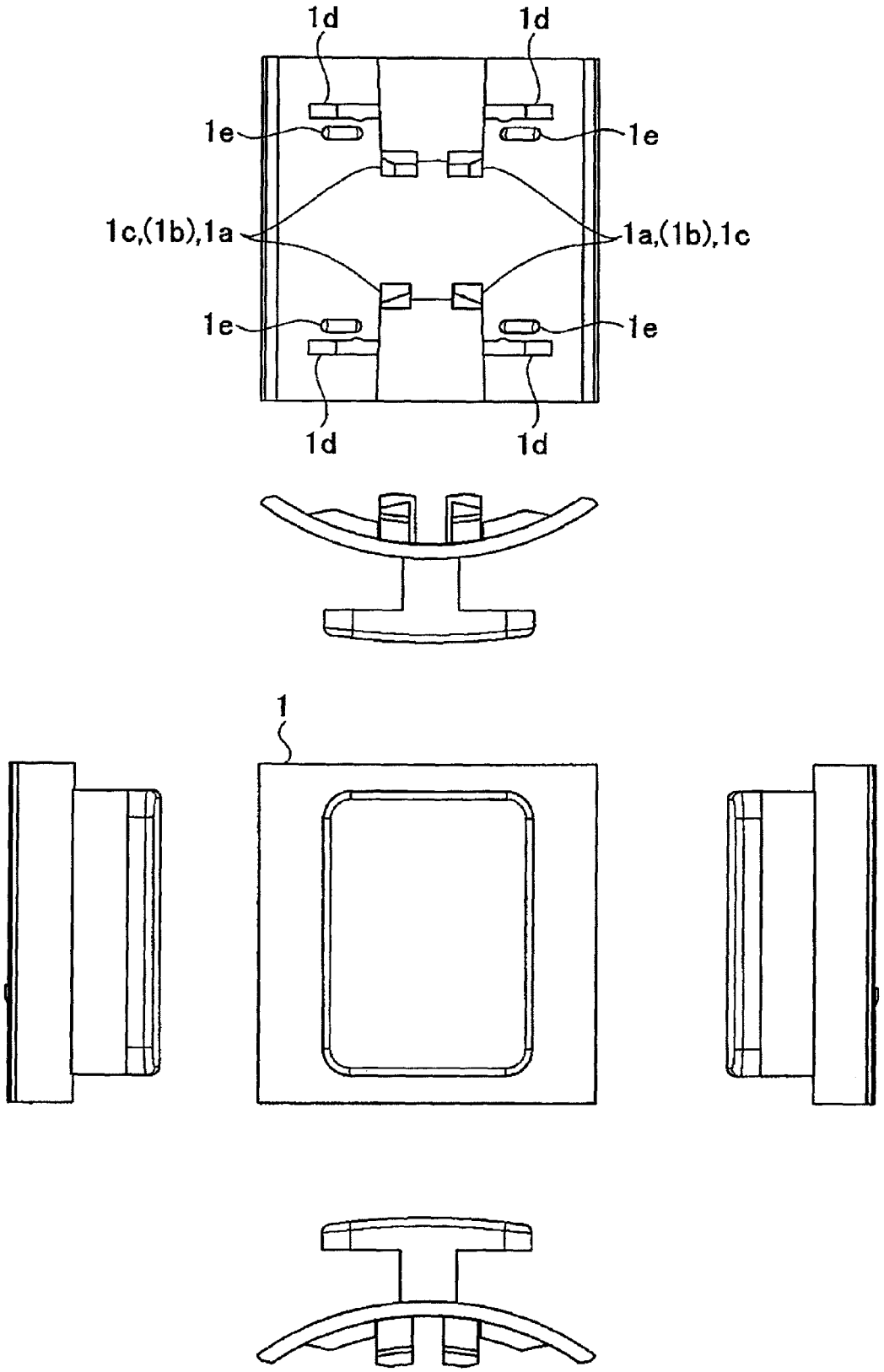
FIG. 22 provides trigonometric six basic views illustrating the operating member shown in FIG. 1.

On the other hand, as shown in FIG. 20 and FIG. 21, the case 2 of the base material 23 has the arcuate sliding surface 2*a* to perform as a guide when the operating member 1 rotatively moves, sliding surfaces 2*b* provided as being parallel to the mounting plate 5 and moving the moving member 3 parallel to the mounting surface, sliding portions 2*c* to be engaged with the sliding portions 1*d* of the operating member 1, stopper portions 2*d* to be limiters when the moving member 3 moves, and opening sections 2*e* to be inserted with the engaged portions 1*b* of the operating member 1 and projecting portions 1*a* having click portions 1*c* for snapping in. The case 2 is fixed to the mounting plate 5 by welding or the like after lapping the moving member 3 with the printed wiring board 4 such that the moving member 3 becomes to be movable. In addition, the case 2 is configured of a material with remarkable slidability such as polyacetal because the case 2 has sliding portions with the operating member 1 and the moving member 3.

When embedding the operating member 1 onto the case 2 of the base material 23, by moving the operating member 1 positioned above the base material 23 toward the base material 23, only the projecting portions 1*a* of the operating member 1 get into touch with the opening sections 2*e* of the case 2, and the projecting portions 1*a* of the operating member 1 and the opening sections 2*e* of the case 2 deform elastically. More specifically, the projecting portion 1*a* shown in the right side of FIG. 7 elastically deforms toward the left side to generate a reaction force which allows the edge of the relevant opening section 2*e* to deform elastically towards the right side, and concurrently with this, the projecting portion 1*a* shown in the left side of FIG. 7 elastically deforms toward the right side to generate a reaction force which allows the edge of the relevant opening section 2*e* to deform elastically towards the left side.

Thereafter, by further moving the operating member 1 toward the base material 23, these above elastic deformations are released, and the sliding portions 1*d* of the operating member 1 and the sliding portions 2*c* of the case 2 are engaged with each other thereby completing the embedment of the operating member 1 to the case 2.

In the status of completing the embedment in such a manner, the projecting portions 1*a* of the operating member 1 penetrate the opening sections 2*e* of the case 2, and the click portions 1*c* formed with top ends of the projecting portions 1*a* of the operating member 1 prevent the operating member 1 from separating from the case 2 thereby allowing the operating member 1 to be supported.

Figure 24:
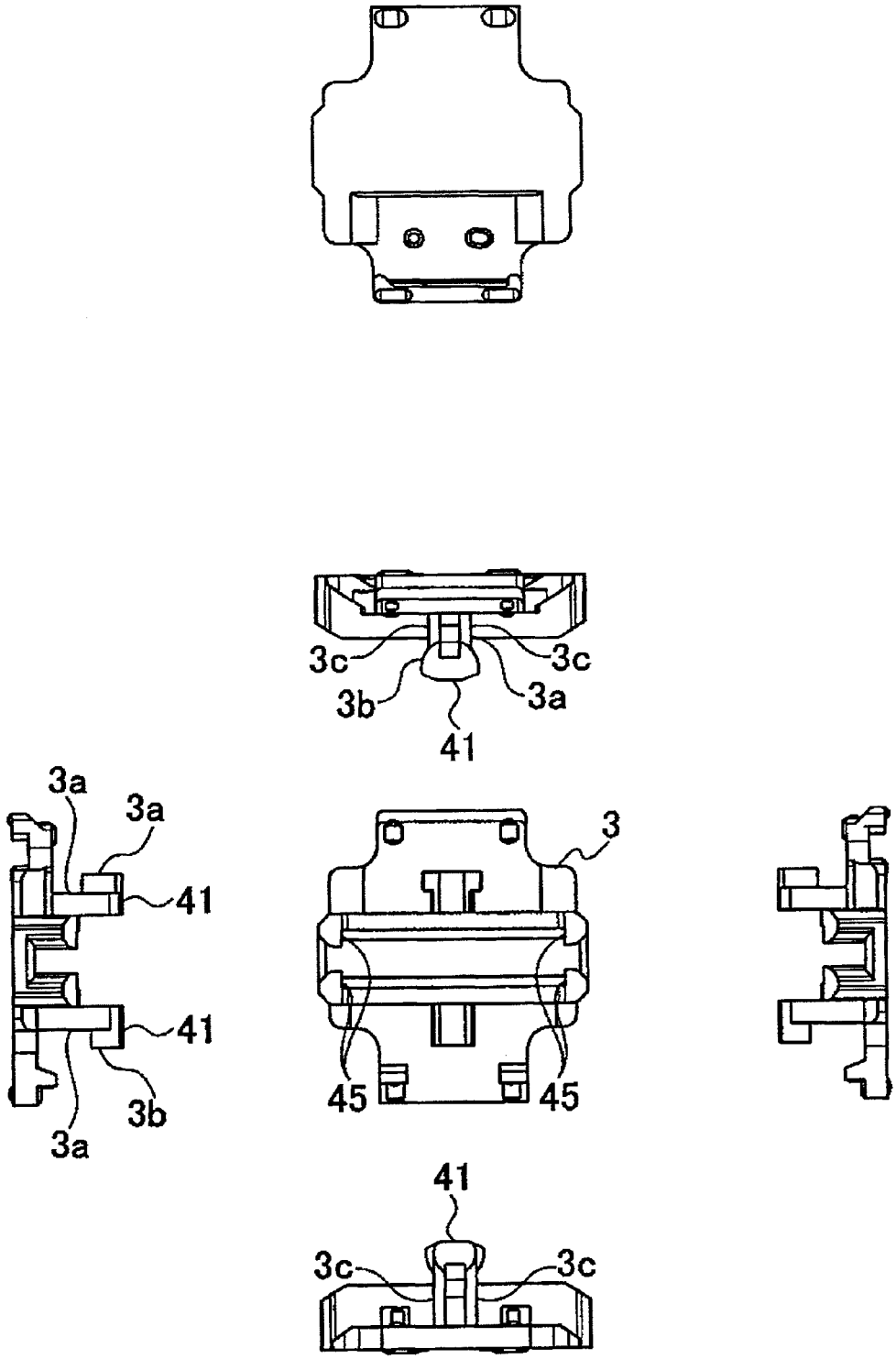
FIG. 24 provides trigonometric six basic views illustrating the moving member shown in FIG. 1.
Figure 25:
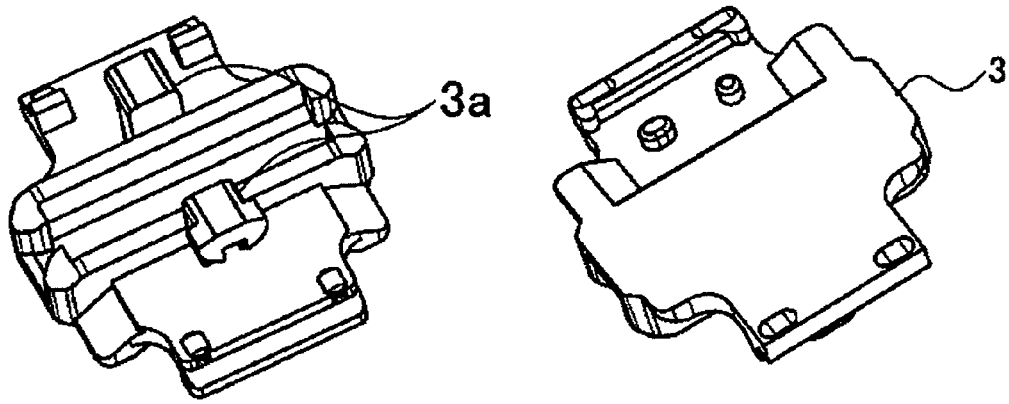
FIG. 25 provides perspective views illustrating the moving member shown in FIG. 1.
Figure 26:
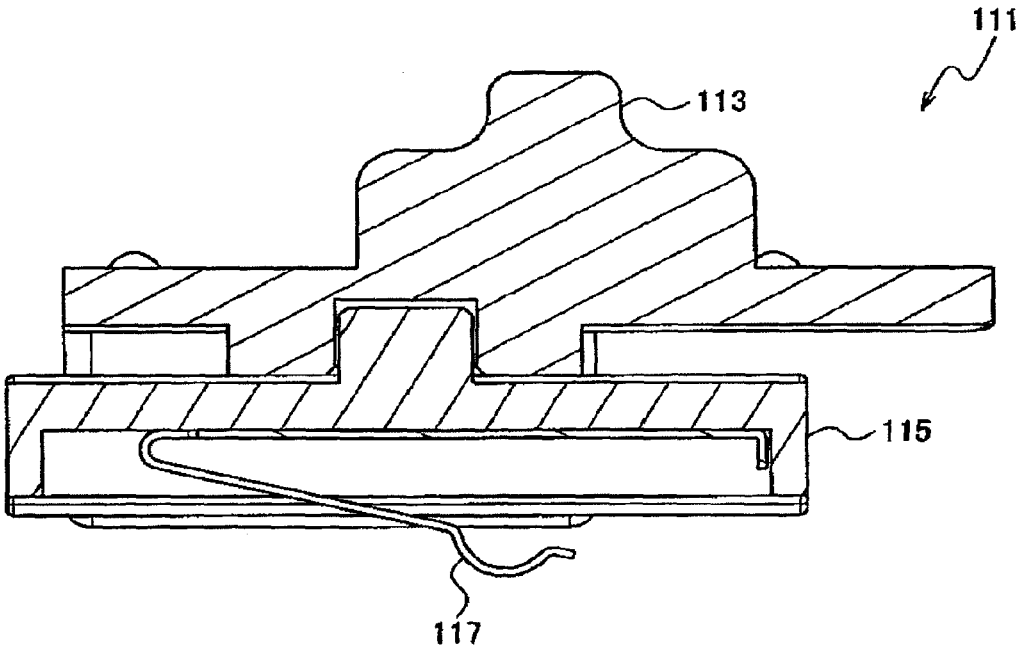
FIG. 26 Prior Art
FIG. 26 is a cross-sectional view illustrating a prior art slide switch.

As shown in FIG. 24 and FIG. 25, the moving member 3 has at least one fitting portion 3*a* (corresponding to the second engaging portion of the invention) formed with curved surfaces 3*b* to be nipped between one pair of projecting portions 1*a* of the operating member 1 and projecting toward the side (upper side in FIG. 3) where the operating member 1 is provided, and limiting portions 3*c* to limit the movement of the moving member 3 when getting in touch with the stopper portions 2*d* of the case 2. In the shown example, two fitting portions 3*a* are provided each corresponding to the one pair of projecting portions 1*a* of the operating member 1. In addition, the moving member 3 has a concave area formed to be attached with the switching brush 6, and the switching brush 6 is attached in such a manner that the contact 27 is projected by a certain amount, thereby providing a structure where the switching brush 6 is restricted to flexurally bend within a certain range even though the moving member 3 is pressed onto the printed wiring board 4.

The slide switch 21 according to the present embodiment involves the converting mechanism 9 which converts the circular arcuate movement of the operating member 1 into the rectilinear movement of the moving member 3, and the converting mechanism 9 comprises the projecting portions 1*a* of the operating member 1 and the fitting portions 3*a* of the moving member 3. Alternatively, projecting portions similar to the projecting portions 1*a* may be formed on the moving member 3 side, and fitting portions similar to the fitting portions 3*a* may be formed on the operating member 1 side.

As described hereinbefore, the operating member 1 has two pairs of projecting portions 1*a* arranged in the width direction at the side (lower side in FIG. 3) to be engaged with the case 2 and to be provided with the moving member 3, and the moving member 3 has two fitting portions 3*a* each of which projects toward the side (upper side in FIG. 3) to be provided with the operating member 1 and is to be nipped between each pair of the projecting portions 1*a* of the operating member 1.

Each fitting portion 3*a* has a top end formed with curved surfaces 3*b* each fanning a part of cylindrical shape, and each curved surface 3*b* of the top end forms a sliding pair with each projecting portion 1*a* of the operating member 1 thereby allowing the moving member 3 to move with scarce space responding to the movement of the operating member 1. In addition, the top end of the cylindrical fitting portion 3*a* has a cut off portion 41 at an area to be located on the operating member 1 side (upper side in FIG. 3) and not to be touched with the projecting portions 1*a* of the operating member 1 in order that the fitting portion 3*a* becomes to be with less projection amount.

Moreover, the slide switch 21 according to the present embodiment has an original position reset mechanism 90 for resetting the operating member 1 to a predetermined original position at the time of departing therefrom. The original position reset mechanism 90 is configured essentially of a compression coil spring 8 as an elastic body, and rubber-made cushions 7 structured of materials having shock-absorbing characteristics.

Figure 5:
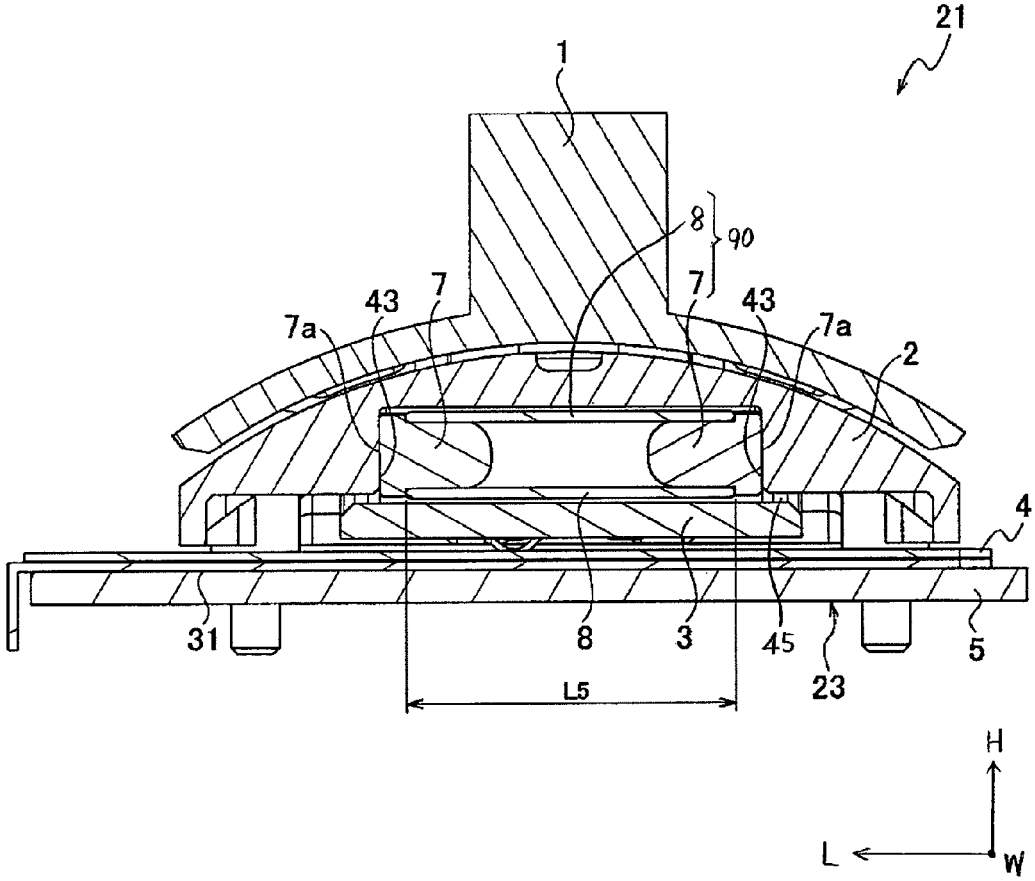
FIG. 5 is a cross-sectional view along the line B-B in FIG. 2 (operating member 1 being at neutral position)

The compression coil spring 8 is to spring-bias the moving member 3 in order that the moving member 3 and the operating member 1 are positioned at the center regions of strokes thereof, that is, at neutral positions shown in FIG. 3 and FIG. 5. In addition, the rubber-made cushions 7 are provided at both end portions of the compression coil spring 8 in the extensible direction thereof.

The compression coil spring 8 is provided between a pair of stopper portions 43 of the case 2 such that the extensible direction of the compression coil spring 8 corresponds to the movement direction of the moving member 3. In the status where the compression coil spring 8 is provided in such a manner, each cushion 7 is, as shown in FIG. 5, pressed to each stopper portion 43 thereby elastically deforming the compression coil spring 8, and the compression coil spring 8 becomes to have a first length L5 shorter than the free length thereof.

Figure 6:
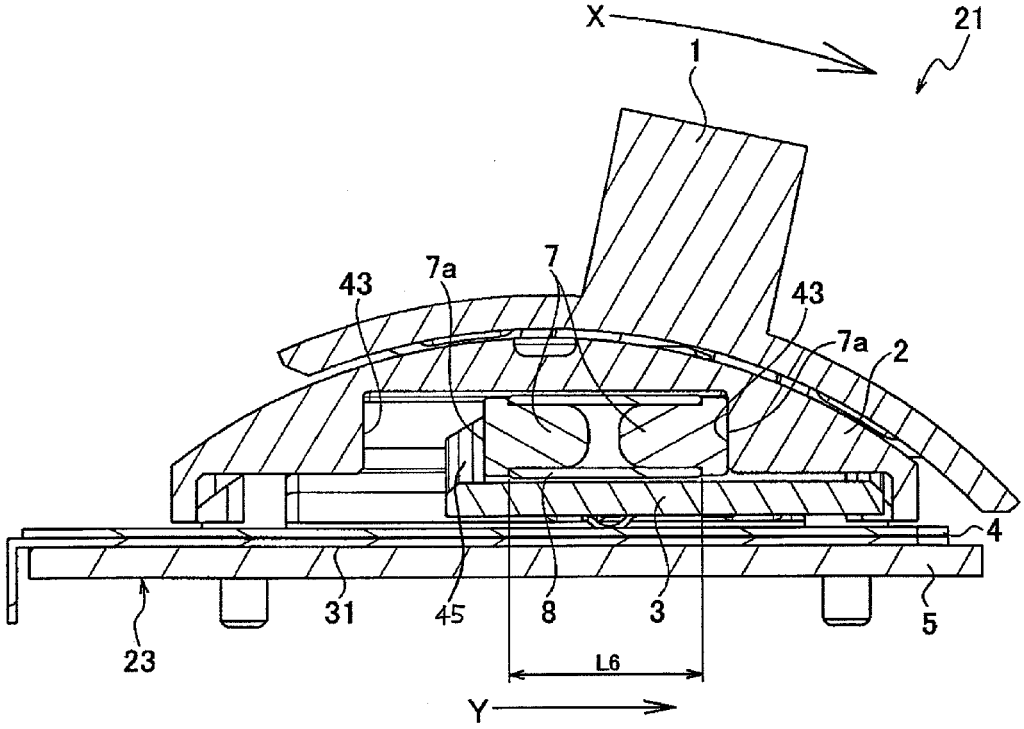
FIG. 6 is a cross-sectional view along the line B-B in FIG. 2 (operating member 1 being at one side)

As shown in FIG. 5, both ends of the coil spring 8 are attached with the rubber-made cushions 7, and the rubber-made cushions 7 and the coil spring 8 are embedded into the case 2 approximately in the vicinity of the center thereof with the moving member 3 in the status where the coil spring 8 is compressed. Referring to the neutral position shown in FIG. 5, one ends of the rubber-made cushions 7 are inserted into the coil spring 8, and other ends 7*a* are pressed to the case 2 and the moving member 3. Therefore, when the operating member 1 moves from the neutral position as shown in FIG. 6, the end surface 7*a* of one rubber-made cushion 7 is pressed to the moving member 3 and the end surface 7*a* of the other rubber-made cushion 7 is pressed to the case 2. Thus, there is obtained a structure where the moving member 3 is forced to return to the neutral position in such a manner.

More specifically, when the moving member 3 and the operating member 1 are positioned at center regions of strokes thereof as shown in FIG. 3 or FIG. 5, the compression coil spring 8 becomes to be with the first length L5, and one cushion 7 out of the cushions 7 is pressed to collision portions 45 of one side provided on the moving member 3, while the other cushion 7 out of the cushions 7 is pressed to collision portions 45 of the other side provided on the moving member 3.

Figure 4:
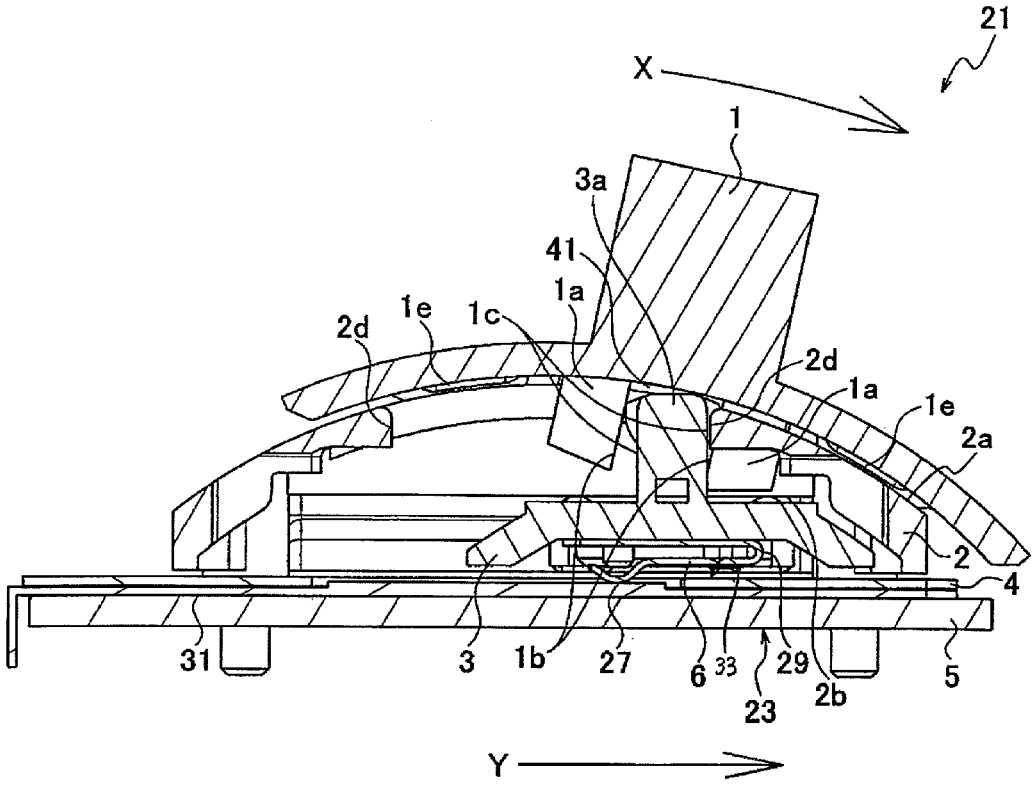
FIG. 4 is a cross-sectional view along the line A-A in FIG. 2 (operating member 1 being at one side)

In contrast, when the moving member 3 is moved from the neutral position as shown in FIG. 4 or FIG. 6, the compression coil spring 8 is elastically deformed to be with a second length L6 (refer to FIG. 6) shorter than the first length L5 because the compression coil spring 8 is compressed between collision portions 45 of one side out of the collision portions 45 and one stopper portion 43 out of the stopper portions 43.

Figure 13:
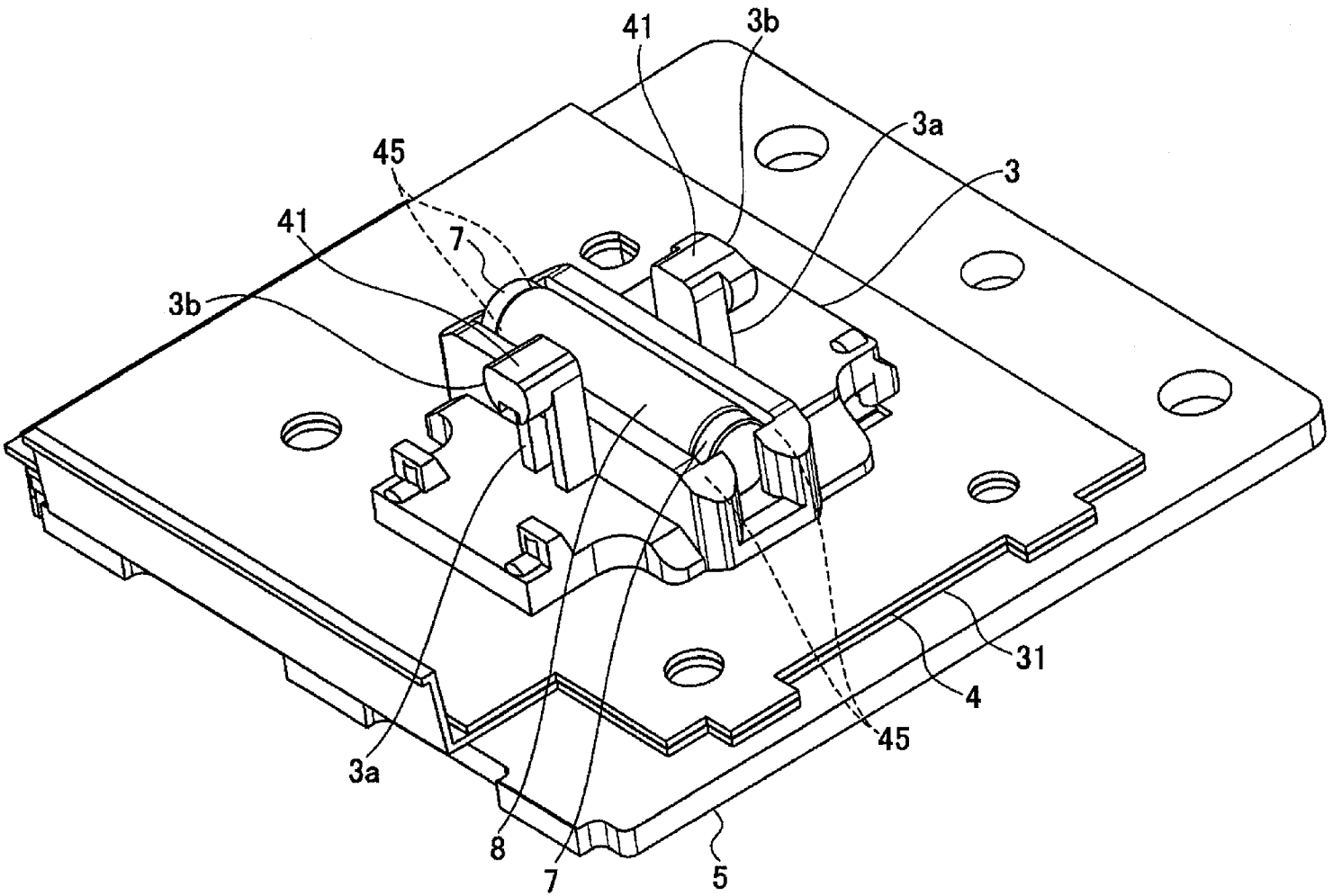
FIG. 13 is a perspective view illustrating a status where the case is subtracted from the status shown in FIG. 12.

It is to be noted that, in the width direction of the slide switch 21, as shown in FIG. 13, the collision portions 45 of the moving member 3 intervene between the stopper portions 43 of the case 2. Therefore, when the moving member 3 and the operating member 1 are at center regions of strokes thereof, the cushion 7 located at one end of the compression coil spring 8 is to be pressed with one stopper portion 43 and two stopper portions 43, while the cushion 7 located at the other end of the compression coil spring 8 is also to be pressed with the other stopper portion 43 and the other two collision portions 45. In contrast, when the moving member 3 and the operating member 1 are moved from the neutral positions, the cushion 7 located at one end of the compression coil spring 8 is pressed only with one stopper portion 43, while the cushion 7 located at the other end of the compression coil spring 8 is pressed only with two collision portions 45.

The switching brush 6 is attached to the moving member 3, and is to be slid on the wiring patterns 4*a* thereby causing an electrical signal to be generated.

Figure 14:
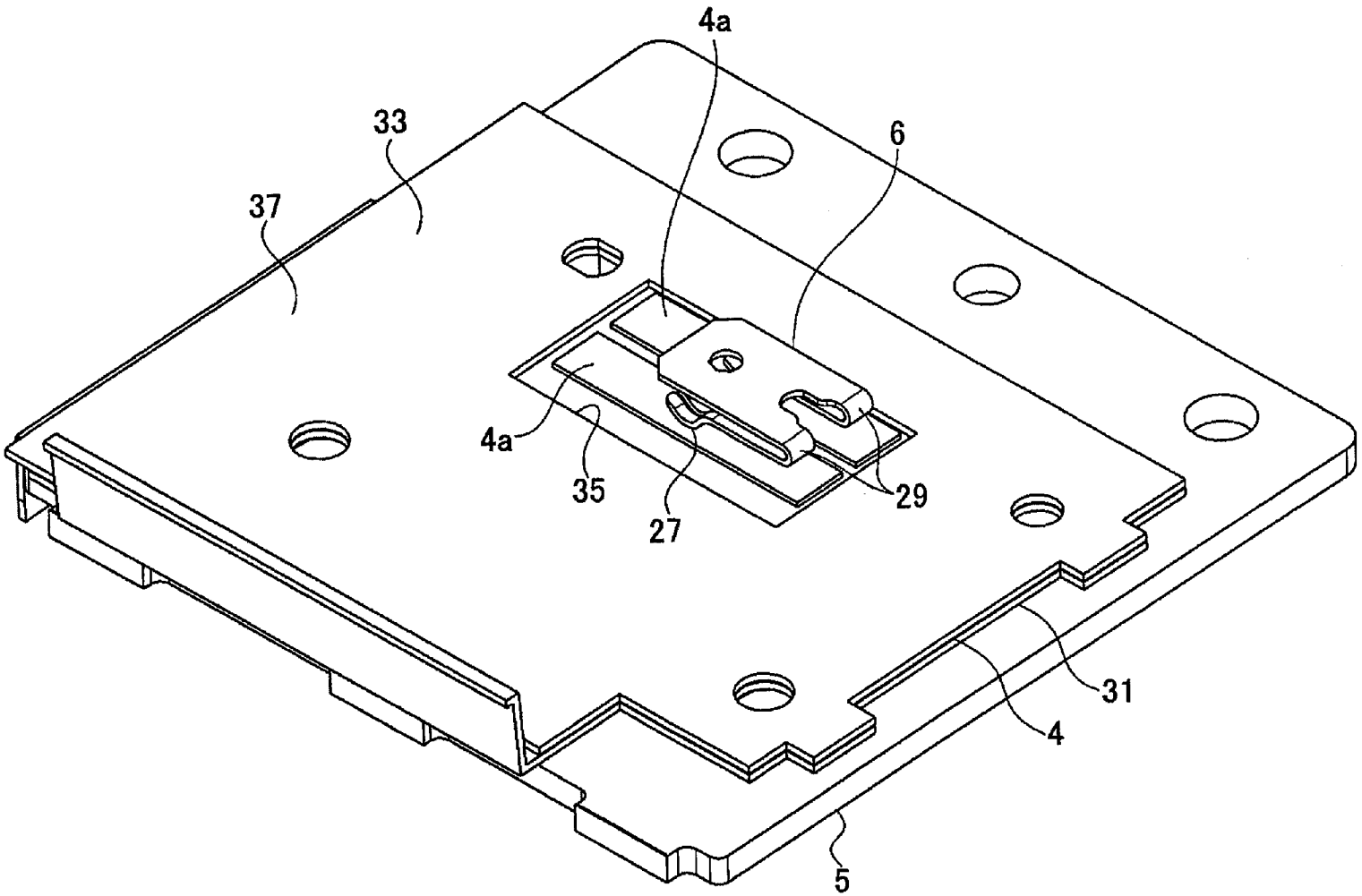
FIG. 14 is a perspective view illustrating a status where the moving member, rubbers and coil spring are subtracted from the status shown in FIG. 13.
Figure 15:
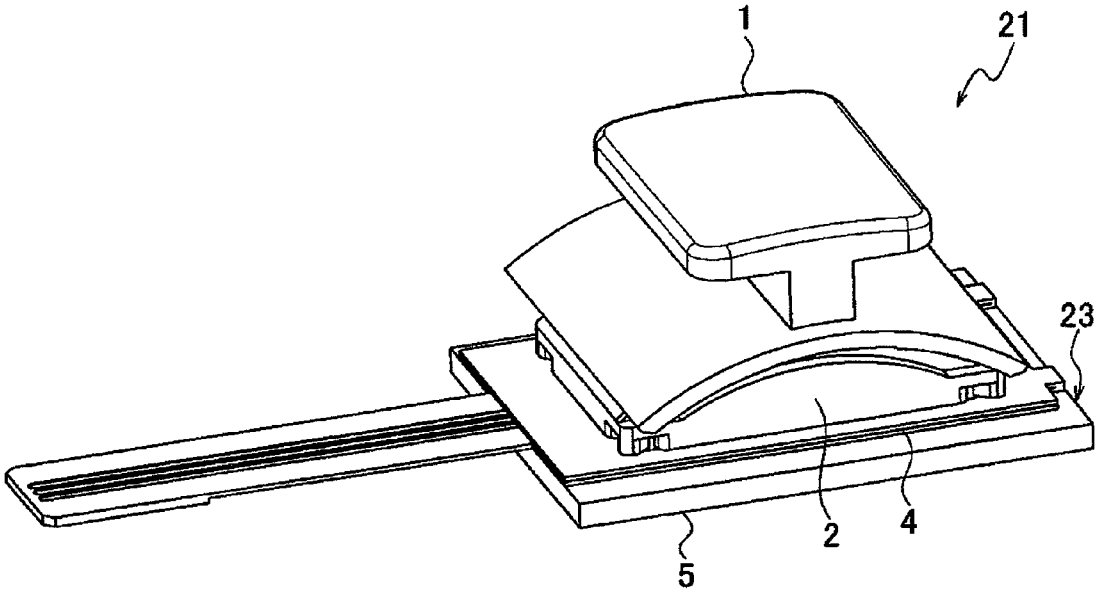
FIG. 15 is a perspective view illustrating a status where the printed wiring board is embedded into the slide switch shown in FIG. 1.

As shown in FIG. 14, the switching brush 6 according to the present embodiment is obtained through preparing a thin plate-like member formed with contacts 27 at one end area and having an elasticity, and folding the thin plate-like member along a region 29 such that the contacts 27 are located outward, thereby to be formed as being narrow width U-shaped. In addition, the switching brush 6 has an elasticity in a direction connecting between the one end area of the switching brush 6 and the other end area facing thereto, that is, the height direction (vertical direction in FIG. 3) of the slide switch 21.

More specifically, the other end area side of the switching brush 6 is integrally provided on the moving member 3 such that a direction connecting the contacts 27 and the other end area to the folded region 29 corresponds to the movement direction of the moving member 3 i.e. such that the folded switching brush 6 is to become extended in the horizontal direction in FIG. 3. By providing the switching brush 6 in such a manner, the contacts 27 are exposed outward at the lower side of the moving member 3 thereby being to contact with the wiring patterns 4*a*.

The contacts 27 of the switching brush 6 are deviated away from the center of the moving member 3 by a certain distance L1 in the movement direction of the moving member 3 (the horizontal direction in FIG. 3; the longitudinal direction of the slide switch). In addition, the folded region 29 of the switching brush 6 is positioned at the opposite side to the contacts 27 across the center of the moving member 3.

Particularly in the present embodiment, the center position of the moving member 3 in the movement direction (horizontal direction in FIG. 3) of the moving member 3 and the center position of the switching brush 6 in the direction connecting between the contacts 27 and the folded region 29 are coincident with each other. In other words, the dimension L2 and the dimension L3 shown in FIG. 3 are substantially equal to each other.

The printed wiring board 4 has: a thin plate-like printed wiring board main body 31 configured of an insulating member such as resin; a conductor thin film 33 configured of a conductive member of metal or the like such as silver and thinly provided on substantially whole of one surface of the printed wiring board main body 31 in the thickness direction thereof; wiring patterns 4*a* provided on the other surface of the printed wiring board main body 31 in the thickness direction thereof and on one end side of the longitudinal direction of the printed wiring board main body 31; and a through opening 35 provided on the other end side of the longitudinal direction of the printed wiring board main body 31. The wiring patterns 4*a* are provided on the thin plate-like printed wiring board 4 described hereinbefore by means of patterning.

Figure 16:
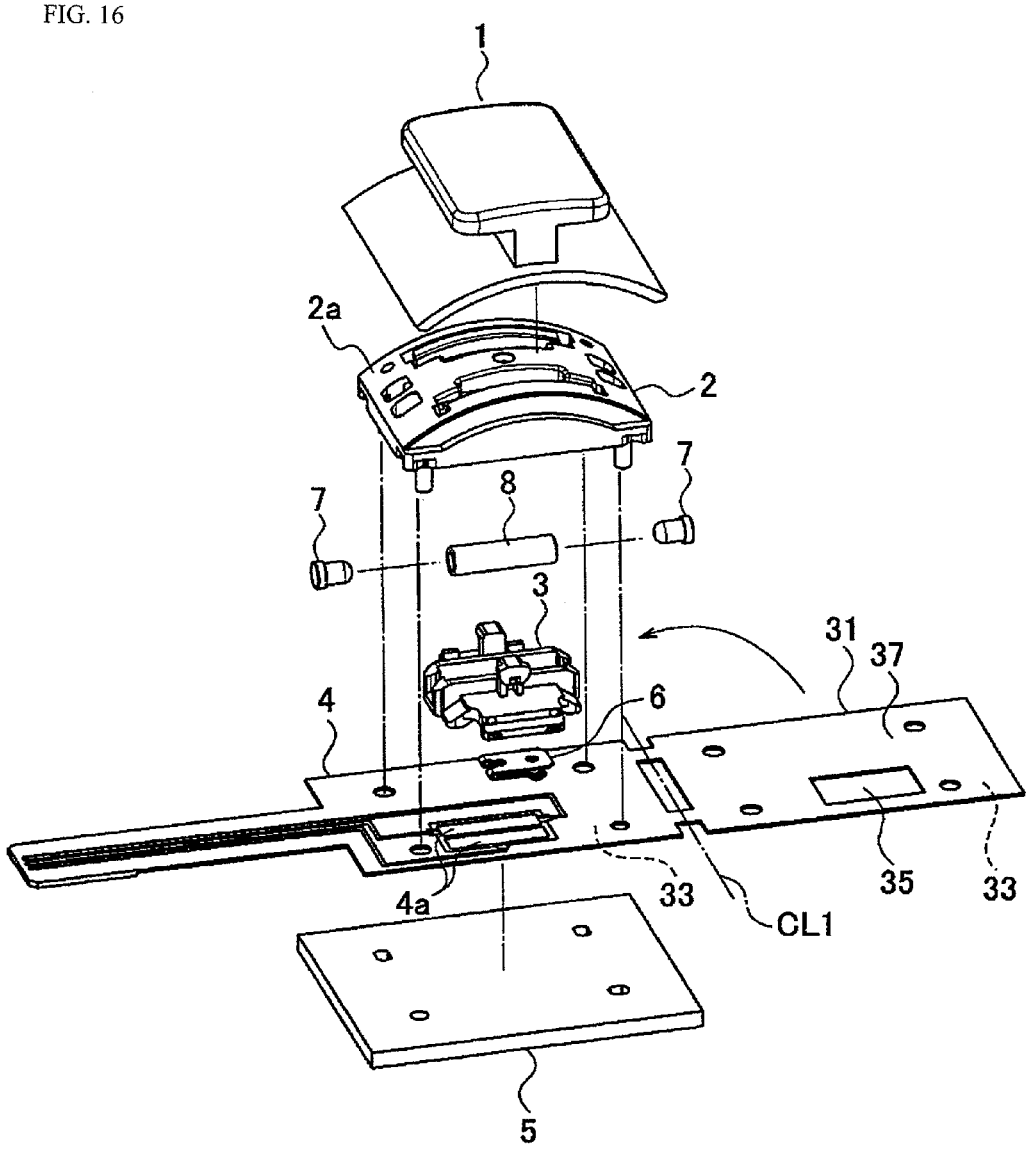
FIG. 16 is a perspective view illustrating a status where the slide switch is exploded in FIG. 15 (the printed wiring board not being folded)
Figure 17:
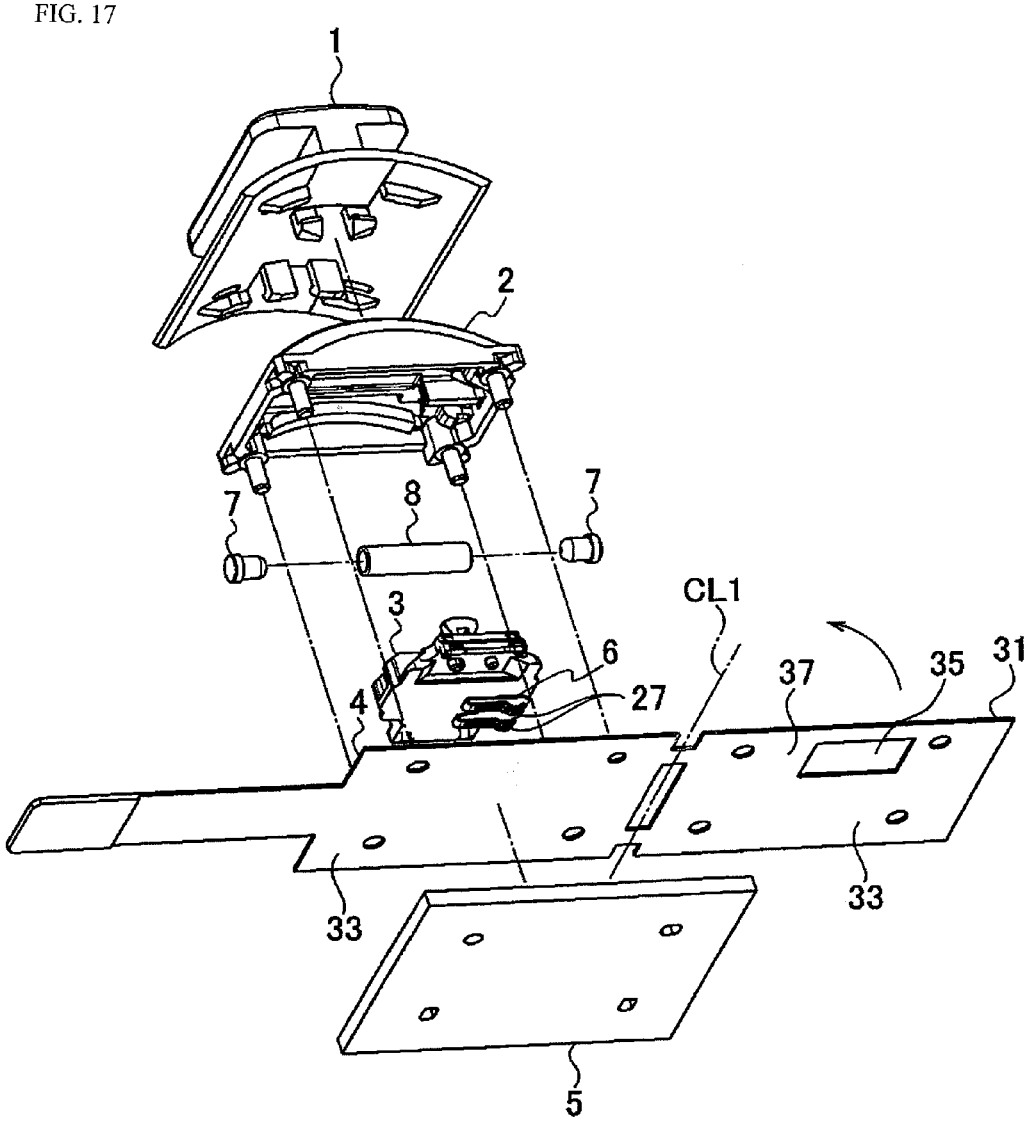
FIG. 17 is a perspective view illustrating a status where the slide switch is exploded in FIG. 15 (the printed wiring board not being folded)
Figure 18:
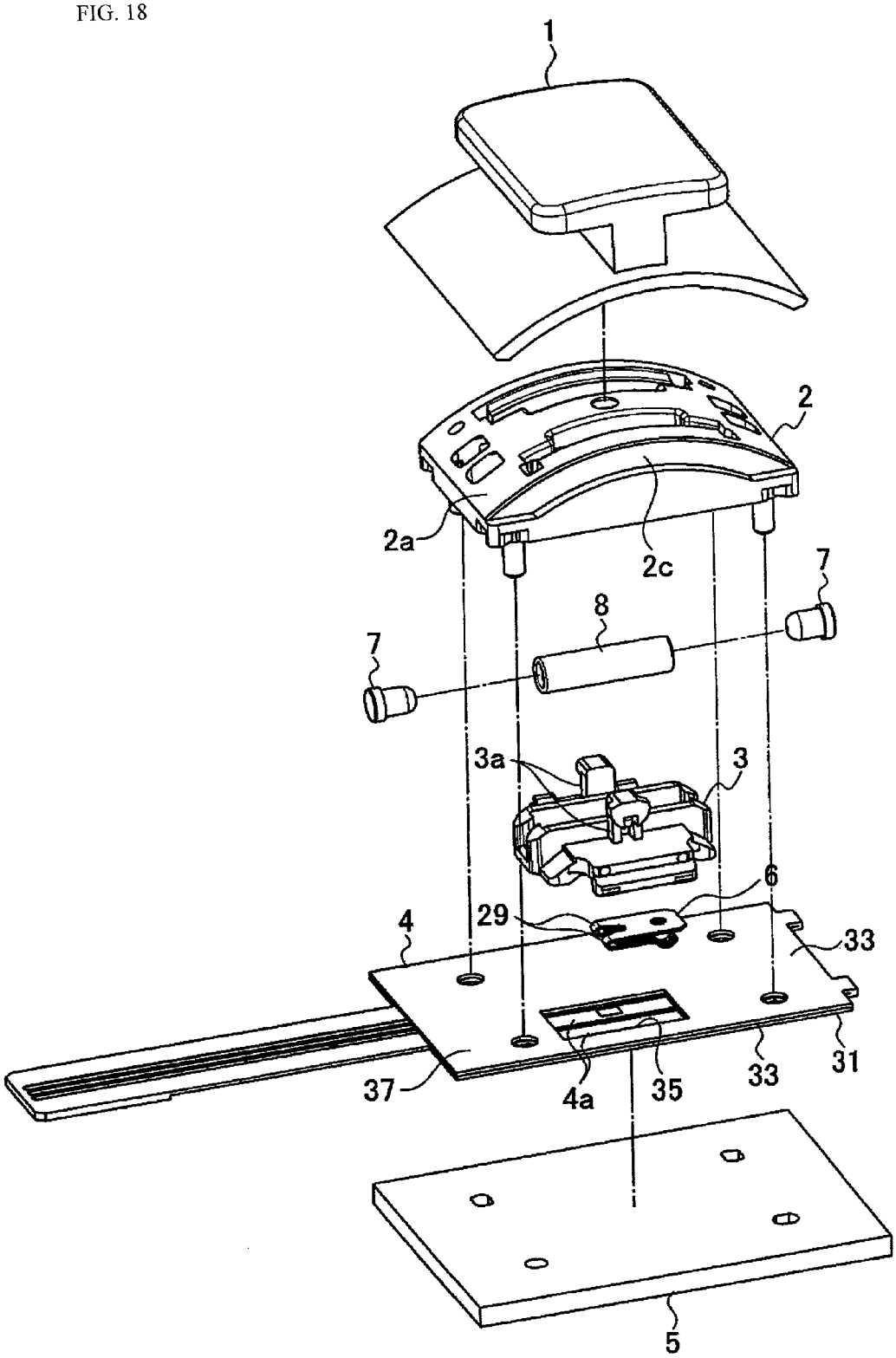
FIG. 18 is a perspective view illustrating a status where the slide switch is exploded in FIG. 15 (the printed wiring board being folded)

The printed wiring board 4 is, as shown in FIG. 16 and FIG. 17, formed to be folded at the center region (straight line CL1) in the longitudinal direction of the printed wiring board main body 31 thereby being duplicated such that the conductor thin film 33 is located outward (refer to FIG. 18). In such a status where the printed wiring board 4 is duplicated in itself, only the wiring patterns 4*a* and the region in the vicinity thereof are exposed to be approachable via the through opening 35.

In addition, the printed wiring board 4 is provided integrally with the mounting plate 5 such that a region 37 of one end side in the longitudinal direction on which the through opening 35 is not provided is contacted with the mounting plate 5 i.e. such that the wiring patterns 4*a* are exposed upward in FIG. 3, and the moving member 3 contacts with and slides on a region (region on which the conductor thin film 33 is provided; region of the conductor thin film 33 shown in FIG. 4 as being flat plane, for example) of the printed wiring board 4 other than the region on which the through opening 35 is provided.

Figure 10:
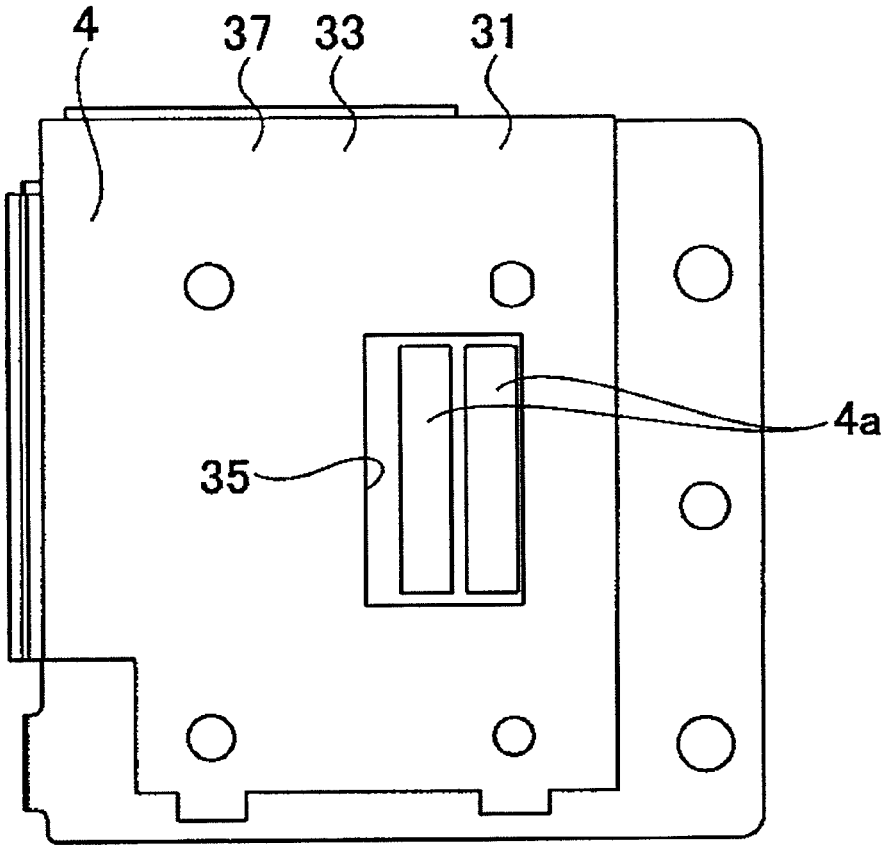
FIG. 10 is a plan view illustrating an example of wiring patterns of a printed wiring board.

FIG. 10 illustrates an example of wiring patterns for a zooming volume switch of a video camera, wherein wiring patterns 4*a* configured of carbon resistive elements are arranged in rectangular shapes on the printed wiring board 4. One wiring pattern 4*a* is a common pattern and the other wiring pattern 4*a* constitutes a resister. As shown in FIG. 14, by coincidentally contacting the switching brush 6 with two wiring patterns 4*a* and moving the switching brush 6, the resistance through the wiring patterns 4*a* changes thereby to generate an analog electrical signal.

Figure 11:
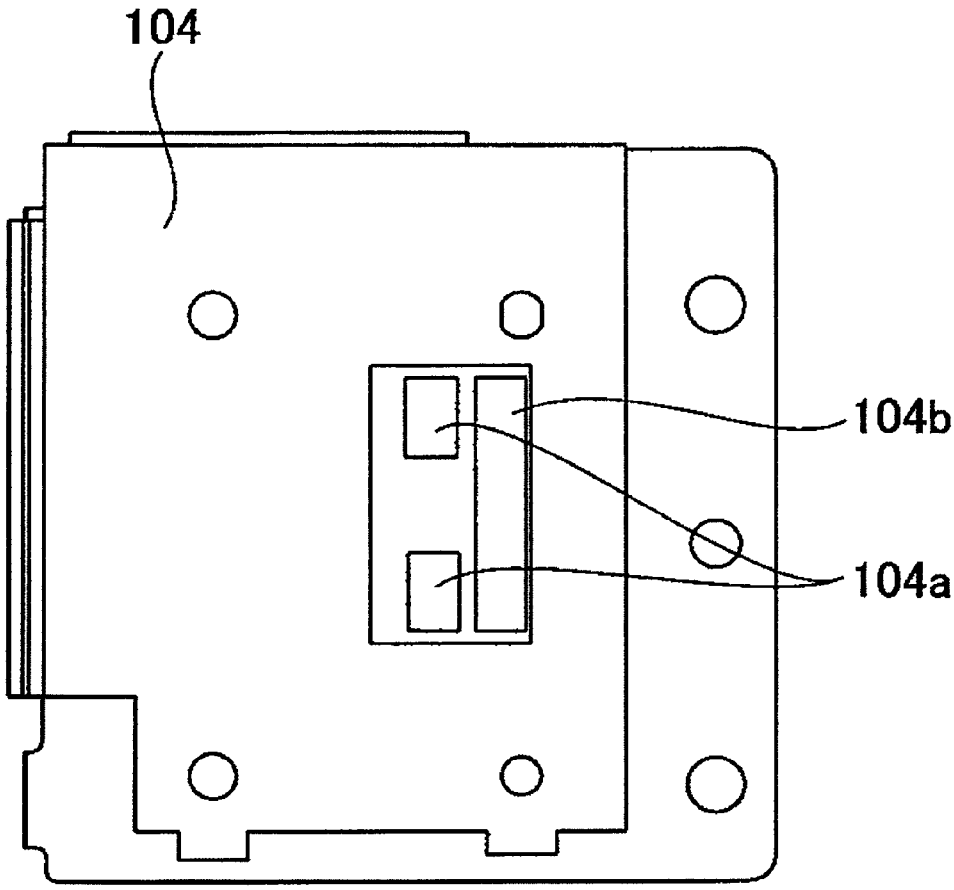
FIG. 11 is a plan view illustrating another example of wiring patterns of a printed wiring board.
Figure 12:
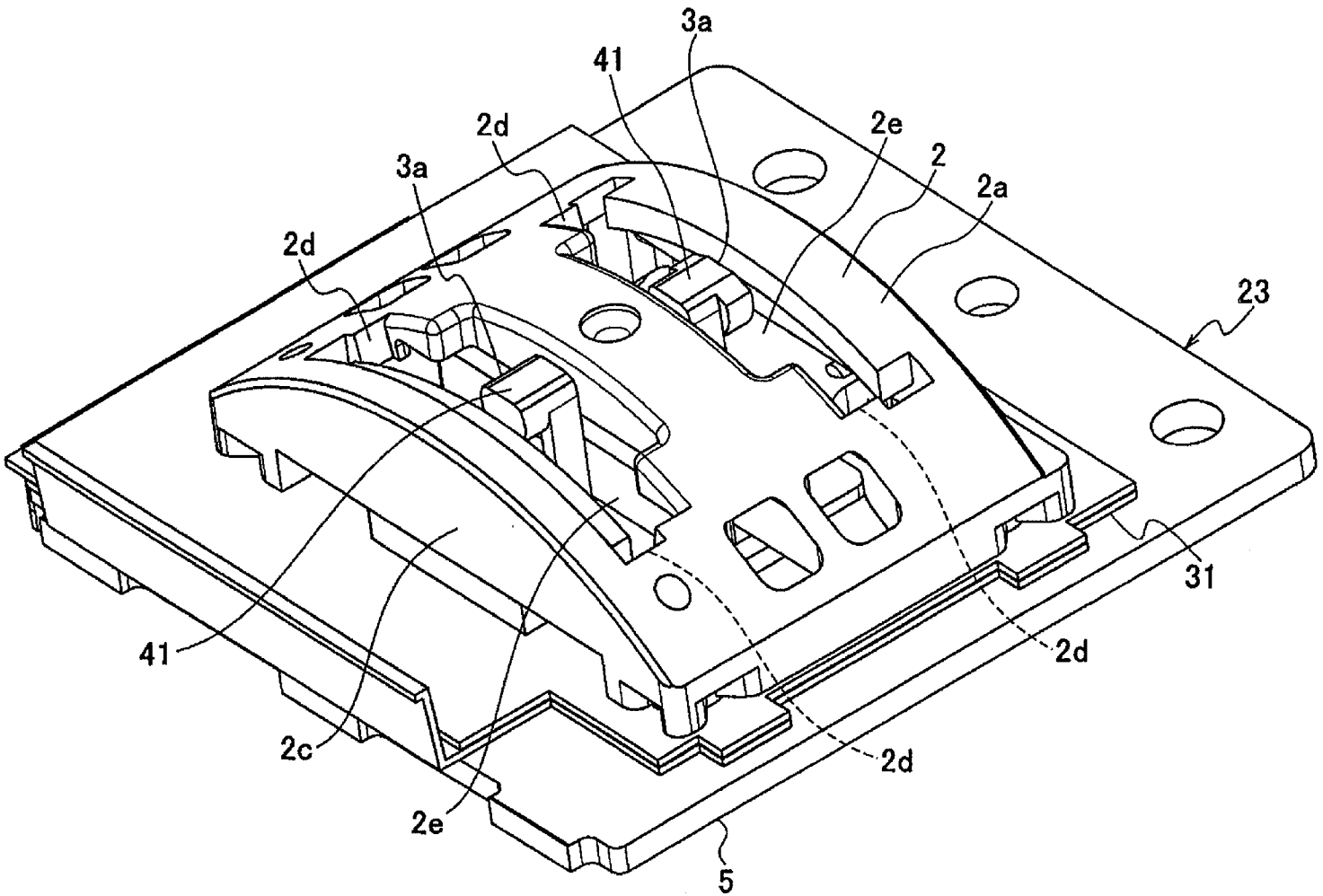
FIG. 12 is a perspective view illustrating a status where the operating member is subtracted from the slide switch shown in FIG. 1.

On the other hand, FIG. 11 illustrates an example of wiring patterns for an ON/OFF switch, wherein wiring patterns 104*a* and 104*b* configured of carbon resistive elements are provided on a printed wiring board 104. The wiring patterns 104*a* are patterns for signals and the wiring pattern 104*b* is a common pattern. In this case, there are generated digital signals such as an ON signal when the switching brush 6 is coincidentally positioned on the wiring pattern 104*a* and the wiring pattern 104*b* and an OFF signal when the switching brush 6 is not coincidentally positioned on the wiring pattern 104*a* and the wiring pattern 104*b*.

The operation will be hereinafter described.

Figure 8:
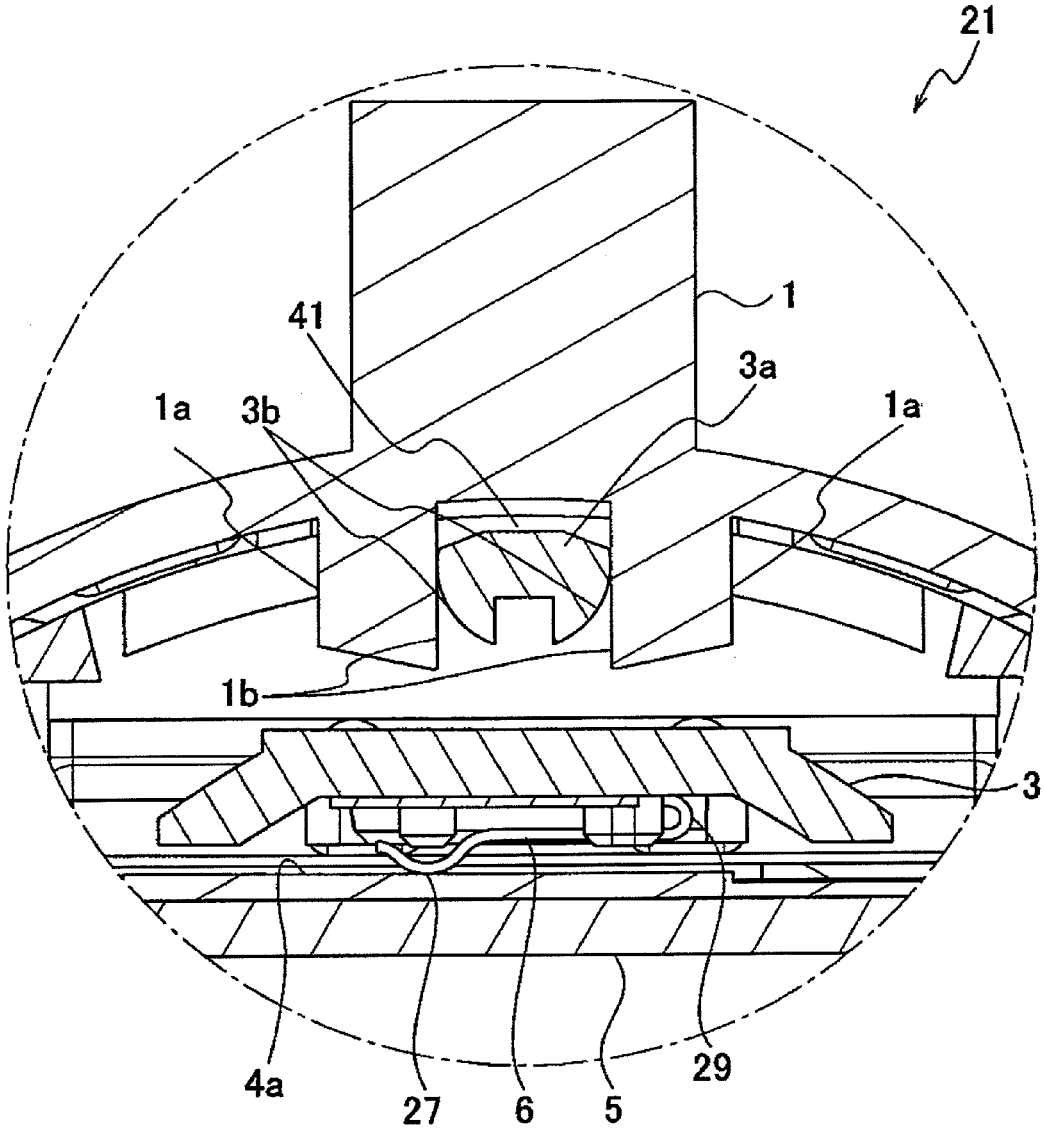
FIG. 8 is an enlarged view of a fitting portion of the moving member shown in FIG. 3.
Figure 9:
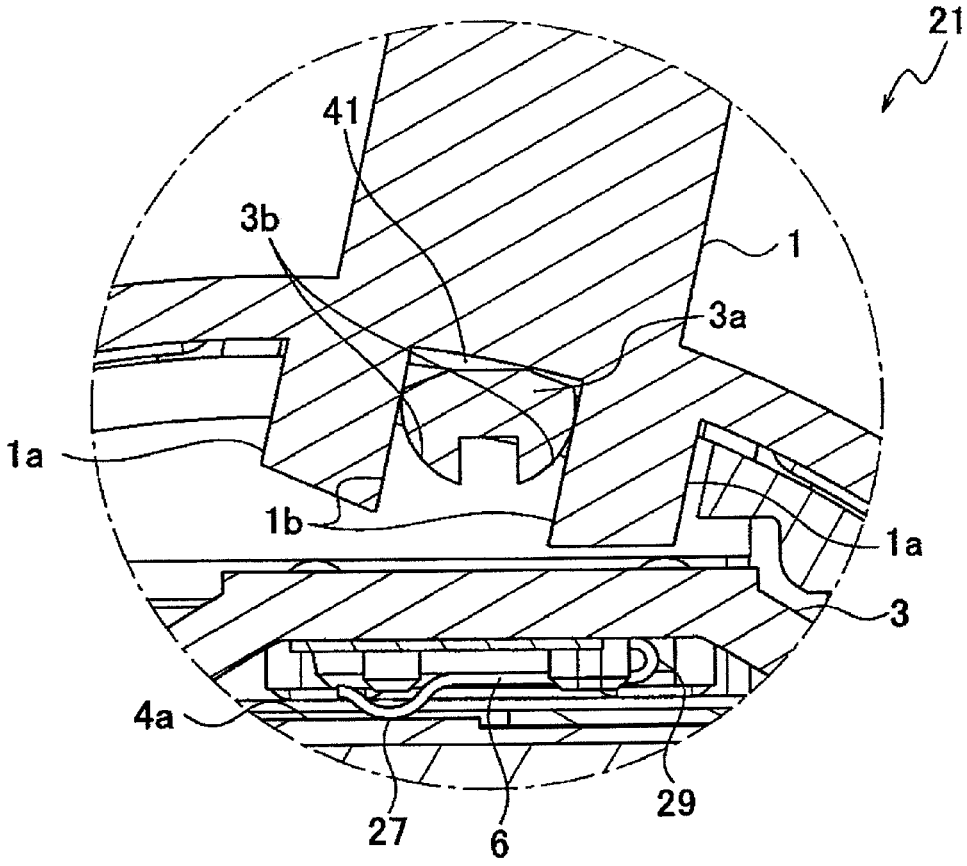
FIG. 9 is an enlarged view of a fitting portion of the moving member shown in FIG. 4.

As shown in FIG. 4, when a force in the direction of X arrow is applied to the operating member 1 in the slide switch 21 constructed as the above manner, the operating member 1 rotatively moves along the sliding surface 2*a* of the case 2 in the direction of X arrow. According to the rotative movement of the operating member 1, as shown in FIG. 8 and FIG. 9, inner wall surfaces of the projecting portions 1*a* of the operating member 1 allows the moving member 3 to move in the direction of Y arrow against the compression coil spring 8 while sliding between the curved surfaces 3*b* of the moving member 3.

Thereafter, the moving member 3 stops to move when the limiting portion 3*c* of the moving member 3 makes contact with the stopper portion 2*d* of the case 2, and thus the strokes of the operating member 1 and the moving member 3 are determined.

Because the switching brush 6 provided integrally with the moving member 3 moves in the same manner with the moving member 3, the switching brush 6 slides on the wiring patterns 4*a* of the printed wiring board 4 thereby causing a signal to be generated in accordance with the position thereof.

Thereafter, if the force in the direction of X arrow is released, then the compression coil spring 8 forces the moving member 3 and the operating member 1 to return to the neutral positions thereof and the switching brush 6 also returns to the neutral position responding to the moving member 3, and thus after sliding on the wiring patterns 4*a* of the printed wiring board 4, the switching brush 6 causes a signal to be generated depending on the neutral position.

Incidentally, the slide switch 21 according to the present embodiment may be assembled in the following manner.

Figure 19:
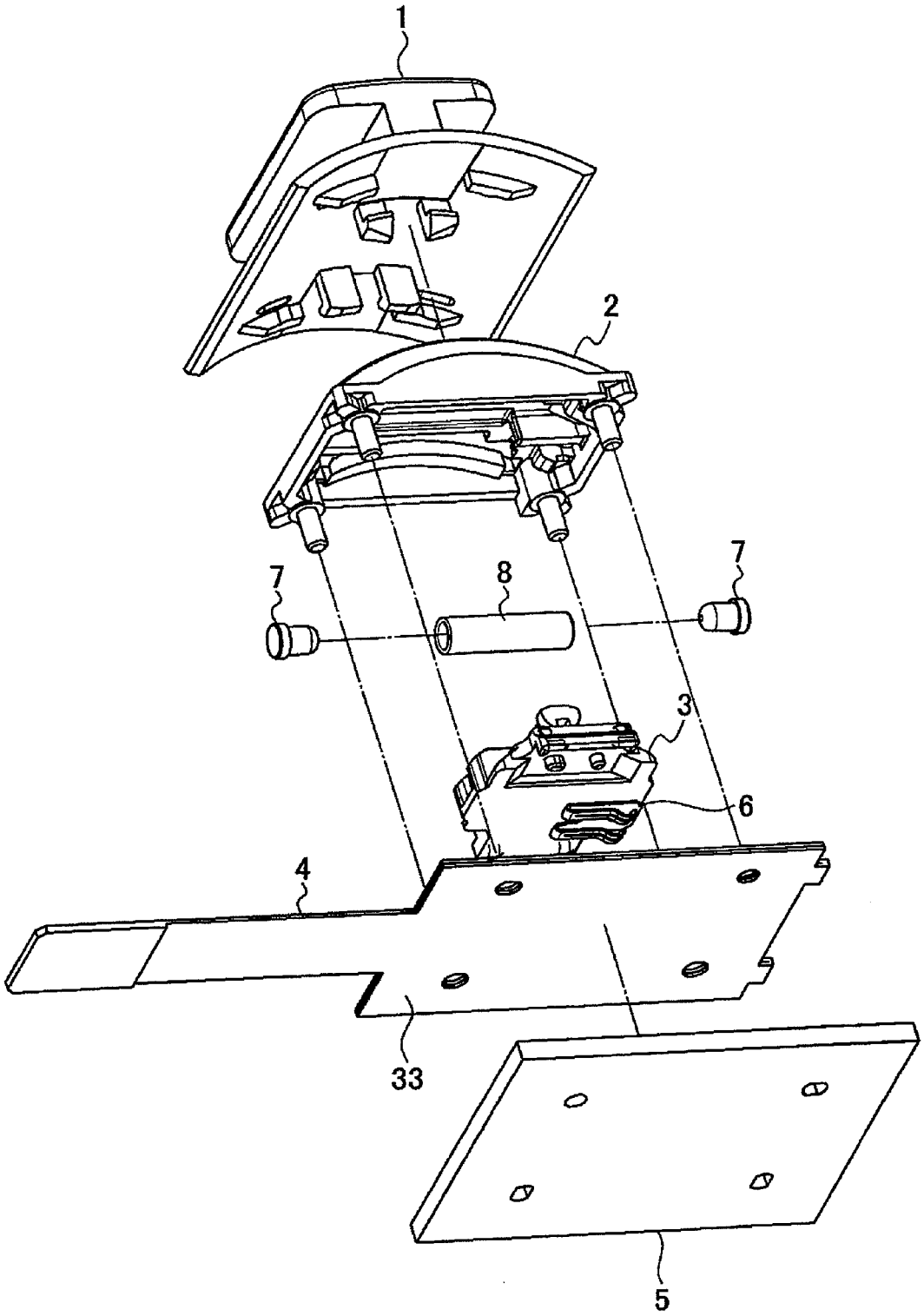
FIG. 19 is a perspective view illustrating a status where the slide switch is exploded in FIG. 15 (the printed wiring board being folded)

At first, the printed wiring board 4 in the status shown in FIG. 16 and FIG. 17 is folded at the region of the straight line CL1 to be as shown in FIG. 18 and FIG. 19. The switching brush 6 (brush 6) is integrally fixed to the moving member 3 by welding, for example, in the status as shown in FIG. 18 and FIG. 19.

Next, the cushions 7 are attached to both ends of the compression coil spring 8, and the compression coil spring 8 and the cushions 7 are provided on the moving member 3.

Then, the case 2 is integrally fixed to the mounting plate 5 by welding, for example, such that the printed wiring board 4 and the moving member 3 provided with the compression coil spring 8 and the cushions 7 intervene between the case 2 and the mounting plate 5. Thereafter, the operating member 1 is attached to the case 2, and thus the slide switch 21 is completed to be assembled.

Figure 27:
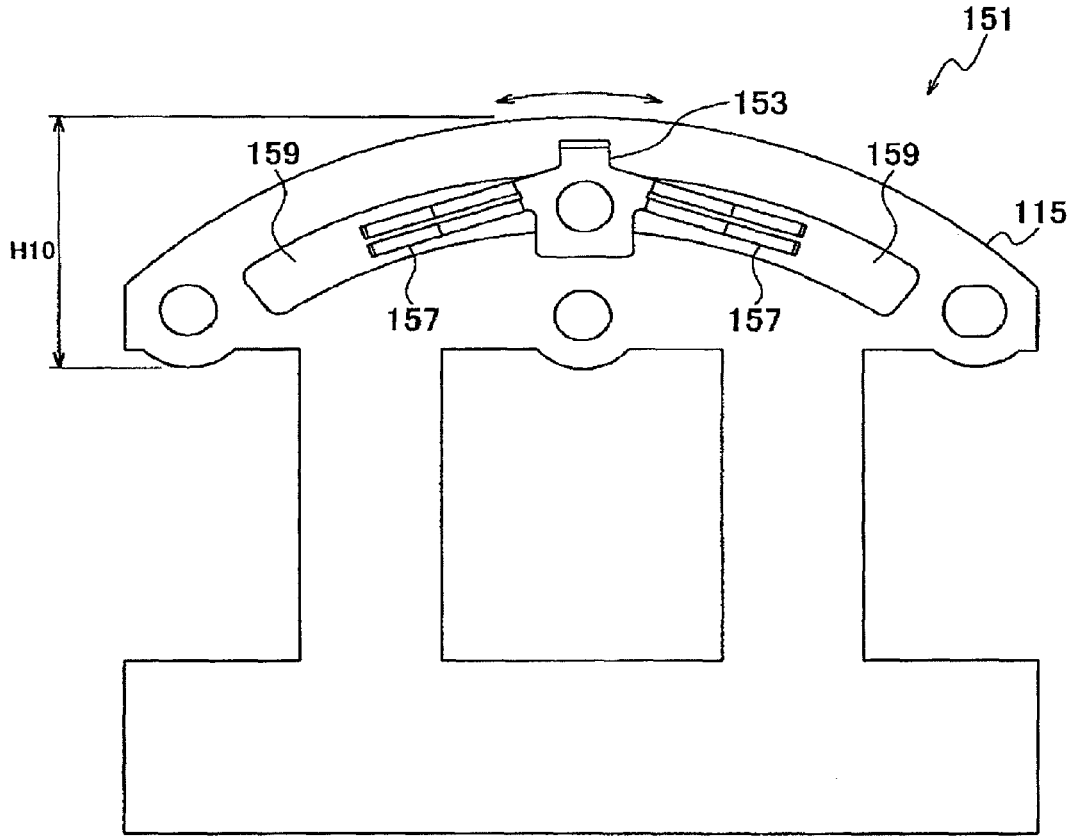
FIG. 27 Prior Art
FIG. 27 is a schematic view illustrating another prior art slide switch.
Figure 28:
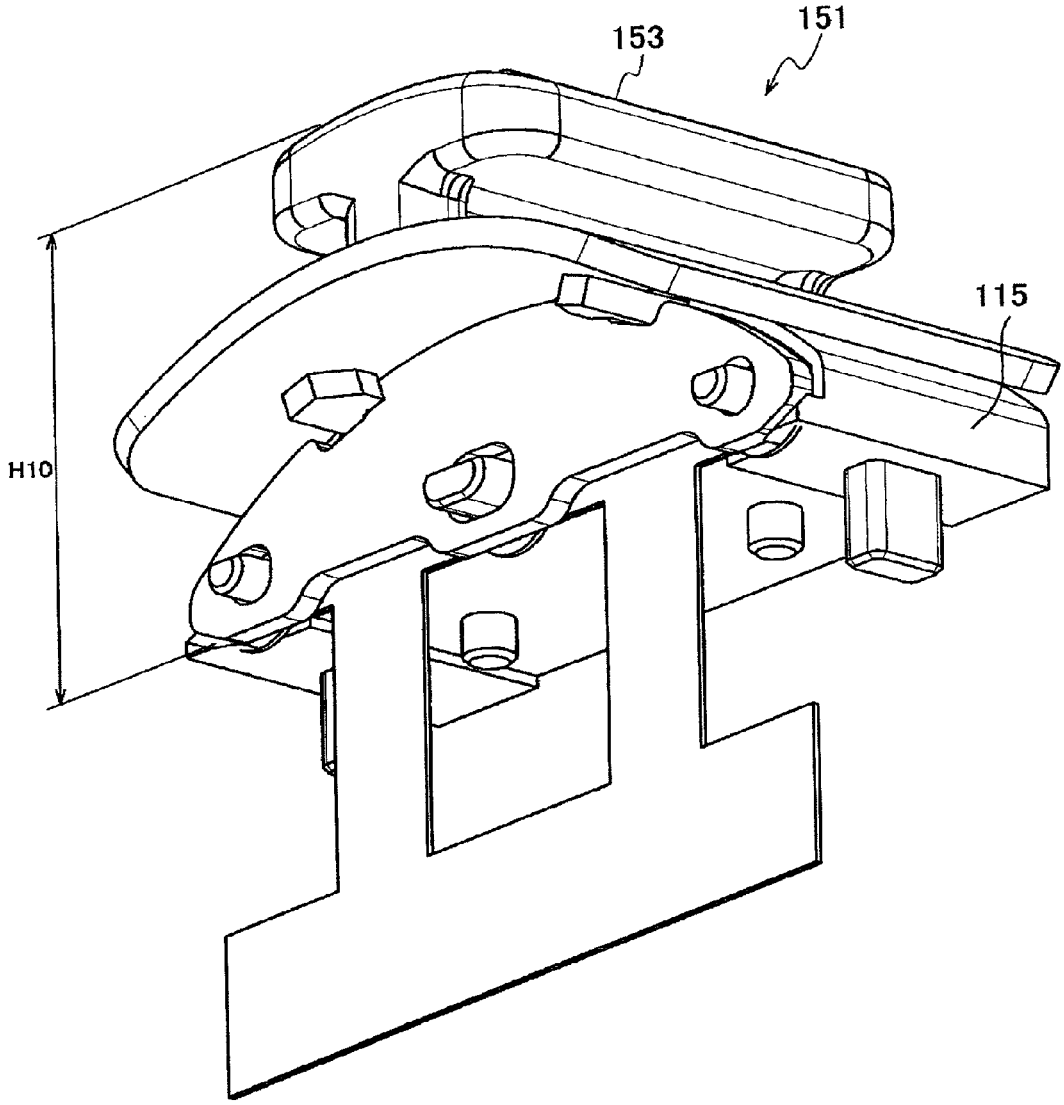
FIG. 28 Prior Art
FIG. 28 is a perspective view illustrating the slide switch shown in FIG. 27.

As described above, the slide switch 21 according to the present embodiment is constructed such that the operating member 1 moves circular arcuately and the moving member 3 provided with the switching brush 6 moves rectilinearly. Therefore, the wiring patterns 4*a* to be contacted with the switching brush 6 are enabled to be formed rectilinearly. In addition, the height of the slide switch is enabled to be more reduced than that of the prior art slide switch (for example, the prior art slide switch 151 shown in FIG. 27) without reducing the movement stroke of the operating member 1 i.e. in spite of approximately equalizing the movement stroke with that of the prior art slide switch 111, for example, and without increasing the dimension (longitudinal size) of the operating member 1 in the movement (sliding) direction i.e. in spite of approximately equalizing the dimension with that of the prior art slide switch 151, for example.

Moreover, the slide switch 21 according to the present embodiment has a structure where the operating member 1 and the moving member 3 are provided separately. Therefore, even though the operating member 1 is applied with a force to twist the operating member 1 (for example, rotational moment to change the attitude of the operating member 1), the twisting force is hard to be transmitted to the moving member 3 and the switching brush 6. Accordingly, the attitudes of the moving member 3 and the switching brush 6 are difficult to change, and the displacements of the contacts 27 (pattern misalignments) of the switching brush 6 relative to the wiring patterns 4*a* provided on the printed wiring board 4 are prevented from occurring.

Furthermore, according to the slide switch 21, deviating positions of the contacts 27 allows the longitudinal dimension of the slide switch 21 (sizes of the operating member 1 and the moving member 3 in the movement directions) to be shortened.

More specifically, if the structure shown in FIG. 3 is such that the contacts 27 are shifted to the right direction to be at the same positions as the center positions of the operating member 1 and the moving member 3, the folded region 29 of the switching brush 6 is to move by the same distance to the right. Thus, the length of the slide switch 21 is required to be longer responding to the distance of movement toward the right. Meanwhile, there may be a conceivable modification that only the contacts 27 are moved toward the right without moving the folded region 29 of the switching brush 6 toward the right. However, such modification may disable the switching brush 6 to obtain a sufficient elasticity (elasticity in the vertical direction in FIG. 3; elasticity required for pressing the wiring patterns 4*a* with the contacts 27), thereby causing a contact failure and the like to occur between the contacts 27 and the wiring patterns 4*a*.

In the slide switch 21 according to the present embodiment, the contacts 27 are deviated away from the center of the moving member 3 by the certain distance L1 in the movement direction of the moving member 3, and the folded region 29 is positioned at the opposite side to the contacts 27 across the center of the moving member 3. Therefore, the switching brush 6 is enabled to obtain a sufficient elasticity thereby to prevent a contact failure and the like from occurring between the contacts 27 and the wiring patterns 4*a* and to avoid an increase in the longitudinal dimension of the slide switch 21.

In addition, according to the slide switch 21 of the present embodiment, at the time of embedding the operating member 1 to the base material 23, only the projecting portions 1*a* of the operating member 1 get into touch with the opening sections 2*e* of the case 2, and both the projecting portions 1*a* of the operating member 1 and the opening sections 2*e* of the case 2 deform elastically. Therefore, it becomes unnecessary to increase the projecting amounts (heights) of the projecting portions 1*a* of the operating member 1 in order for the projecting portions 1*a* of the operating member 1 to be easily deformed. Accordingly, even though the projecting amounts of the projecting portions 1*a* of the operating member 1 are small, the operating member 1 is to be easily embedded to the case 2, and thus it is enabled to suppress the increase of the height of the slide switch 21.

In addition, according to the slide switch 21 of the present embodiment, the conductor thin film 33 of the printed wiring board 4 is contacted with the mounting plate 5 configured of a conductive material. Therefore, it is enabled to discharge the unwanted charges charged in the printed wiring board 4 to the mounting plate 5 thereby preventing damages of the printed wiring board 4 and the like.

Moreover, the moving member 3 is to contact with and slide on the region 37 (the conductor thin film 33) other than the region of the printed wiring board 4 where the through opening 35 is provided. Therefore, the wiring patterns 4*a* and the printed wiring board main body 31 are avoided from scraping thereby having abilities of long term uses.

In addition, according to the slide switch 21, the cylindrical top end of the fitting portion 3*a* has the cut off portion 41 at the area located on the operating member 1 side in order that the fitting portion 3*a* becomes to be with less projection amount. Therefore, it is enabled to shorten the distance between the moving member 3 and the operating member 1 thereby further lowering the height of the slide switch 21.

In addition, according to the slide switch 21, cushions 7 are provided at both ends of the compression coil spring 8. Therefore, at the time that the moving member 3 returns to the neutral position after having moved from the neutral position, either one of the cushions 7 other than the compression coil spring 8 is to come into collision with the stopper portion 43 of the case 2, thereby absorbing the impact power and suppressing generation of noises.

What is claimed is:

1. A slide switch comprising:

an operating member which moves circular arcuately in a predetermined movement stroke relative to a main surface of a printed wiring board for outputting a plurality of electrical signals and selects between the electrical signals;

a converting mechanism for converting a circular arcuate movement of the operating member into a rectilinear movement relative to the main surface of the printed wiring board;

a moving member rectilinearly moved relative to the main surface of the printed wiring board by the converting mechanism and determining, in cooperation with the printed wiring board, an electrified state corresponding to an electrical signal selected by the operating member; and an original position reset mechanism for resetting the operating member to a predetermined original position;

wherein the original position reset mechanism includes a compression coil spring provided between either one of the operating member and the moving member and a base material provided with the printed wiring board.

2. The slide switch as recited in claim 1, further comprising a base material provided with the printed wiring board and supporting movably each of the operating member and the moving member.

3. The slide switch as recited in claim 1, wherein the converting mechanism comprises:

a pair of first engaging portions provided on either one of the operating member and the moving member; and a second engaging portion provided on other one of the operating member and the moving member and having a curved surface to intervene between the pair of first engaging portions.

4. The slide switch as recited in claim 3, wherein the first engaging portions and the second engaging portion are configured as being sliding pairs for converting the circular arcuate movement of the operating member into the rectilinear movement of the moving member.

5. The slide switch as recited in claim 3, wherein a top end of the second engaging portion has a cut off portion in order that the second engaging portion becomes to be with less projection amount.

6. The slide switch as recited in claim 1, wherein the original reset mechanism further includes cushions provided at both end portions of the compression coil spring, and each cushion is to pressed to the base material when the operating member moves to at least one of end regions of the movement stroke thereof.

7. The slide switch as recited in claim 1, wherein the printed wiring board includes a wiring pattern for generating, with the moving member, an electrical signal which changes in analog form.

8. The slide switch as recited in claim 1, wherein the printed wiring board includes a wiring pattern for generating, with the moving member, an electrical signal which changes in digital form.

9. The slide switch as recited in claim 7, wherein the printed wiring board has:

a thin plate-like main body configured of an insulating material and formed with an through opening;

a conductive thin film configured of a conductive material and provided on one main surface of the main body; and the wiring pattern provided on other main surface of the main body, and the printed wiring board is folded to be duplicated such that the conductive thin film is located outward and the wiring pattern is exposed via the through opening.

10. The slide switch as recited in claim 8, wherein the printed wiring board has:

a thin plate-like main body configured of an insulating material and formed with an through opening;

a conductive thin film configured of a conductive material and provided on one main surface of the main body; and the wiring pattern provided on other main surface of the main body, and the printed wiring board is folded to be duplicated such that the conductive thin film is located outward and the wiring pattern is exposed via the through opening.

11. The slide switch as recited in claim 9, wherein the moving member moves while contacting with a region other than the through opening of the printed wiring board folded to be duplicated.

12. The slide switch as recited in claim 10, wherein the moving member moves while contacting with a region other than the through opening of the printed wiring board folded to be duplicated.

13. The slide switch as recited in claim 7, wherein the moving member is provided with a switching brush having a contact to contact with the wiring pattern.

14. The slide switch as recited in claim 13, wherein the switching brush is configured such that a thin plate-like elastic member having a one end portion formed with the contact is folded in such a manner that the contact is located outward, and the contact and the folded region are located oppositely to each other relative to a center of movement direction of the moving member.

15. A slide switch comprising:

an operating member which moves circular arcuately in a predetermined movement stroke relative to a main surface of a printed wiring board for outputting a plurality of electrical signals and selects between the electrical signals;

a converting mechanism for converting a circular arcuate movement of the operating member into a rectilinear movement relative to the main surface of the printed wiring board; and a moving member rectilinearly moved relative to the main surface of the printed wiring board by the converting mechanism and determining, in cooperation with the printed wiring board, an electrified state corresponding to an electrical signal selected by the operating member;

wherein the converting mechanism comprises:

a pair of first engaging portions provided on either one of the operating member and the moving member; and a second engaging portion provided on other one of the operating member and the moving member and having a curved surface to intervene between the pair of first engaging portions, and the operating member has a sliding portion with less projecting amount than that of the first engaging portions, the base material has an opening section to be engaged with the first engaging portion of the operating member and a sliding portion to be engaged with the sliding portion of the operating member, and when embedding the operating member to the base material, after only the first engaging portions of the operating member are pressed to the opening section of the base material and the first engaging portions and the opening section are elastically deformed, elastic deformations are released and the sliding portion of the operating member and the sliding portion of the base material are engaged with each other.

* * * * *